US006109730A

United States Patent [19]

Nilsson et al.

[11] Patent Number: 6,109,730

[45] Date of Patent: Aug. 29, 2000

[54] DIRECT PRINTING METHOD WITH IMPROVED CONTROL FUNCTION

[75] Inventors: Daniel Nilsson, Yokohama, Japan; A I Agnetha Sandberg, Goteborg, Sweden

[73] Assignee: Array Printers AB Publ., Vastra Frolunda, Sweden

[21] Appl. No.: 09/036,050

[22] Filed: Mar. 6, 1998

Related U.S. Application Data

[60] Provisional application No. 60/039,935, Mar. 10, 1997.

[51] Int. Cl.[7] ..... B41J 2/415; G03G 15/00

[52] U.S. Cl. ..... 347/55

[58] Field of Search ..... 347/10, 11, 55, 347/151, 158

[56] References Cited

U.S. PATENT DOCUMENTS

| | | |
|---|---|---|
| 3,566,786 | 3/1971 | Kaufer et al. . |
| 3,689,935 | 9/1972 | Pressman et al. . |
| 3,779,166 | 12/1973 | Pressman et al. . |
| 3,815,145 | 6/1974 | Tisch et al. . |

(List continued on next page.)

FOREIGN PATENT DOCUMENTS

| | | |
|---|---|---|
| 0345 024 A2 | 12/1989 | European Pat. Off. . |
| 0352 997 A2 | 1/1990 | European Pat. Off. . |
| 0377 208 A2 | 7/1990 | European Pat. Off. . |
| 0389 229 | 9/1990 | European Pat. Off. . |
| 0660 201 A2 | 6/1994 | European Pat. Off. . |

(List continued on next page.)

OTHER PUBLICATIONS

E. Bassous, et al., "The Fabrication of High Precision Nozzles by the Anisotropic Etching of (100) Silicon", *J. Electrochem. Soc.: Solid–State Science and Technology*, vol. 125, No. 8, Aug. 1978, pp. 1321–1327.

Jerome Johnson, "An Etched Circuit Aperture Array for TonerJet® Printing", *IS&T's Tenth International Congress on Advances in Non–Impact Printing Technologies*, 1994, pp. 311–313.

"The Best of Both Worlds," Brochure of Toner Jet® by Array Printers, *The Best of Both Worlds*, 1990.

*Primary Examiner*—Joan Pendegrass

*Attorney, Agent, or Firm*—Knobbe, Martens, Olson & Bear, LLP

[57] ABSTRACT

The present invention relates to a direct electrostatic printing method, in which a stream of computer generated signals, defining an image information, are converted to a pattern of electrostatic fields which selectively permit or restrict the transport of charged toner particles from a particle source toward a back electrode and control the deposition of those charged toner particles in an image configuration onto an image receiving medium. Particularly, the present invention refers to a direct electrostatic printing method performed in consecutive print cycles, each of which includes at least one development period ($t_b$) and at least one recovering period ($t_w$) subsequent to each development period ($t_b$), wherein the pattern of electrostatic fields is produced during at least a part of each development period ($t_b$) to selectively permit or restrict the transport of charged toner particles from a particle source toward a back electrode, and wherein a supplemental voltage source is applied at the beginning of each development period to enhance the transport of the particle source at the beginning of each development period. Advantageously, an additional electric field is produced during at least a part of each recovering period ($t_w$) to repel a part of the transported charged toner particles back toward the particle source. Preferably, the supplemental voltage source is supplied to a guard electrode so as to control the amount of toner attracted from the particle source by each aperture. By controlling the amount of toner attracted by each aperture, the toner may be distributed equally among the apertures thereby preventing toner starvation.

51 Claims, 15 Drawing Sheets

U.S. PATENT DOCUMENTS

| | | | |
|---|---|---|---|
| 4,263,601 | 4/1981 | Nishimura et al. . | |
| 4,274,100 | 6/1981 | Pond . | |
| 4,353,080 | 10/1982 | Cross . | |
| 4,382,263 | 5/1983 | Fischbeck et al. . | |
| 4,384,296 | 5/1983 | Torpey . | |
| 4,386,358 | 5/1983 | Fischbeck . | |
| 4,470,056 | 9/1984 | Galetto et al. . | |
| 4,478,510 | 10/1984 | Fujii et al. . | |
| 4,491,794 | 1/1985 | Daley et al. . | |
| 4,491,855 | 1/1985 | Fujii et al. . | |
| 4,498,090 | 2/1985 | Honda et al. . | |
| 4,511,907 | 4/1985 | Fukuchi . | |
| 4,525,727 | 6/1985 | Kohashi et al. . | |
| 4,571,601 | 2/1986 | Teshima . | |
| 4,675,703 | 6/1987 | Fotland . | |
| 4,717,926 | 1/1988 | Hotomi . | |
| 4,743,926 | 5/1988 | Schmidlin et al. . | |
| 4,748,453 | 5/1988 | Lin et al. . | |
| 4,814,796 | 3/1989 | Schmidlin . | |
| 4,831,394 | 5/1989 | Ochiai et al. . | |
| 4,860,036 | 8/1989 | Schmidlin . | |
| 4,903,050 | 2/1990 | Schmidlin . | |
| 4,912,489 | 3/1990 | Schmidlin . | |
| 5,028,812 | 7/1991 | Bartky . | |
| 5,036,341 | 7/1991 | Larsson . | |
| 5,038,159 | 8/1991 | Schmidlin et al. . | |
| 5,057,855 | 10/1991 | Damouth . | |
| 5,072,235 | 12/1991 | Slowik et al. . | |
| 5,083,137 | 1/1992 | Badyal et al. . | |
| 5,095,322 | 3/1992 | Fletcher . | |
| 5,121,144 | 6/1992 | Larson et al. . | |
| 5,128,695 | 7/1992 | Maeda . | |
| 5,148,595 | 9/1992 | Doggett et al. . | |
| 5,170,185 | 12/1992 | Takemura et al. . | |
| 5,181,050 | 1/1993 | Bibl et al. . | |
| 5,204,696 | 4/1993 | Schmidlin et al. . | |
| 5,204,697 | 4/1993 | Schmidlin . | |
| 5,214,451 | 5/1993 | Schmidlin et al. . | |
| 5,229,794 | 7/1993 | Honma et al. . | |
| 5,235,354 | 8/1993 | Larson . | |
| 5,237,346 | 8/1993 | Da Costa et al. . | |
| 5,256,246 | 10/1993 | Kitamura . | |
| 5,257,045 | 10/1993 | Bergen et al. . | |
| 5,270,729 | 12/1993 | Stearns . | |
| 5,274,401 | 12/1993 | Doggett et al. . | |
| 5,307,092 | 4/1994 | Larson . | |
| 5,329,307 | 7/1994 | Takemura et al. . | |
| 5,374,949 | 12/1994 | Wada et al. . | |
| 5,386,225 | 1/1995 | Shibata . | |
| 5,402,158 | 3/1995 | Larson . | |
| 5,414,500 | 5/1995 | Furukawa . | |
| 5,446,478 | 8/1995 | Larson . | |
| 5,450,115 | 9/1995 | Bergen et al. . | |
| 5,453,768 | 9/1995 | Schmidlin . | |
| 5,473,352 | 12/1995 | Ishida . | |
| 5,477,246 | 12/1995 | Hirabayashi et al. . | |
| 5,477,250 | 12/1995 | Larson . | |
| 5,506,666 | 4/1996 | Masuda et al. . | |
| 5,508,723 | 4/1996 | Maeda . | |
| 5,515,084 | 5/1996 | Larson . | |
| 5,526,029 | 6/1996 | Larson et al. . | |
| 5,558,969 | 9/1996 | Uyttendaele et al. . | |
| 5,559,586 | 9/1996 | Wada . | |
| 5,600,355 | 2/1997 | Wada . | |
| 5,614,932 | 3/1997 | Kagayama . | |
| 5,617,129 | 4/1997 | Chizuk, Jr. et al. . | |
| 5,625,392 | 4/1997 | Maeda . | |
| 5,640,185 | 6/1997 | Kagayama . | |
| 5,650,809 | 7/1997 | Kitamura . | |
| 5,666,147 | 9/1997 | Larson . | |
| 5,677,717 | 10/1997 | Ohashi . | |
| 5,708,464 | 1/1998 | Desie . | |
| 5,774,159 | 6/1998 | Larson . | |
| 5,805,185 | 9/1998 | Kondo . | |
| 5,818,480 | 10/1998 | Bern et al. | 347/55 |
| 5,818,490 | 10/1998 | Larson . | |
| 5,847,733 | 12/1998 | Bern | 347/55 |
| 5,867,191 | 2/1999 | Luque et al. | 347/55 |
| 5,874,973 | 2/1999 | Wakahara | 347/55 |

FOREIGN PATENT DOCUMENTS

| | | |
|---|---|---|
| 072 072 A2 | 7/1996 | European Pat. Off. . |
| 0 743 572 A1 | 11/1996 | European Pat. Off. . |
| 0752 317 A1 | 1/1997 | European Pat. Off. . |
| 0764 540 A2 | 3/1997 | European Pat. Off. . |
| 12 70 856 | 6/1968 | Germany . |
| 26 53 048 | 5/1978 | Germany . |
| 44-26333 | 11/1969 | Japan . |
| 55-55878 | 4/1980 | Japan . |
| 55-84671 | 6/1980 | Japan . |
| 55-87563 | 7/1980 | Japan . |
| 56-89576 | 7/1981 | Japan . |
| 58-044457 | 3/1983 | Japan . |
| 58-155967 | 9/1983 | Japan . |
| 62-248662 | 10/1987 | Japan . |
| 62-13356 | 11/1987 | Japan . |
| 01120354 | 5/1989 | Japan . |
| 05220963 | 8/1990 | Japan . |
| 04189554 | 8/1992 | Japan . |
| 4-268591 | 9/1992 | Japan . |
| 4282265 | 10/1992 | Japan . |
| 5208518 | 8/1993 | Japan . |
| 7-186435 | 12/1993 | Japan . |
| 8-58143 | 8/1994 | Japan . |
| 9048151 | 2/1997 | Japan . |
| 09118036 | 5/1997 | Japan . |
| 2108432 | 5/1983 | United Kingdom . |
| WO 9014960 | 12/1990 | WIPO . |

DIRECT PRINTING METHOD WITH IMPROVED CONTROL FUNCTION

RELATED APPLICATION

The present application claims the benefit of priority under 35 U.S.C. § 119(e) of U.S. Provisional Patent Application Ser. No. 60/039,935 filed on Mar. 10, 1997.

BACKGROUND OF THE INVENTION

1. Field of the Invention

The present invention relates to a direct electrostatic printing method, in which a stream of computer generated signals, defining an image information, are converted to a pattern of electrostatic fields on control electrodes arranged on a printhead structure, to selectively permit or restrict the passage of toner particles through the printhead structure and control the deposition of those toner particles in an image configuration onto an image receiving medium.

2. Description of the Related Art

Of the various electrostatic printing techniques, the most familiar and widely utilized is that of xerography wherein latent electrostatic images formed on a charged retentive surface are developed by a suitable toner material to render the images visible, the images being subsequently transferred to plain paper.

Another form of electrostatic printing is one that has come to be known as direct electrostatic printing (DEP). This form of printing differs from the above mentioned xerographic form, in that toner is deposited in image configuration directly onto plain paper. The novel feature of DEP printing is to allow simultaneous field imaging and toner transport to produce a visible image on paper directly from computer generated signals, without the need for those signals to be intermediately converted to another form of energy such as light energy, as it is required in electrophotographic printing.

A DEP printing device has been disclosed in U.S. Pat. No. 3,689,935, issued Sep. 5, 1972 to Pressman, et al. Pressman, et al., disclose a multilayered particle flow modulator comprising a continuous layer of conductive material, a segmented layer of conductive material and a layer of insulating material interposed therebetween. An overall applied field projects toner particles through apertures arranged in the modulator whereby the particle stream density is modulated by an internal field applied within each aperture.

A new concept of direct electrostatic printing was introduced in U.S. Pat. No. 5,036,341, granted to Larson, which is incorporated by reference herein. According to Larson, a uniform electric field is produced between a back electrode and a developer sleeve coated with charged toner particles. A printhead structure, such as a control electrode matrix, is interposed in the electric field and utilized to produce a pattern of electrostatic fields which, due to control in accordance with an image configuration, selectively open or close passages in the printhead structure, thereby permitting or restricting the transport of toner particles from the developer sleeve toward the back electrode. The modulated stream of toner particles allowed to pass through the opened passages impinges upon an image receiving medium, such as paper, interposed between the printhead structure and the back electrode.

According to the above method, a charged toner particle is held on the developer surface by adhesion forces, which are essentially proportional to $Q^2/d^2$, where d is the distance between the toner particle and the surface of the developer sleeve, and Q is the particle charge. The electric force required for releasing a toner particle from the sleeve surface is chosen to be sufficiently high to overcome the adhesion forces.

However, due to relatively large variations of the adhesion forces, toner particles exposed to the electric field through an opened passage are neither simultaneously released from the developer surface nor uniformly accelerated toward the back electrode. As a result, the time period from when the first particle is released until all released particles are deposited onto the image receiving medium is relatively long.

When a passage is opened during a development period $t_b$, a part of the released toner particles do not reach sufficient momentum to pass through the aperture until after the development period $t_b$ has expired. Those delayed particles will continue to flow through the passage even after closure, and their deposition will be delayed. This in turn may degrade print quality by forming extended, indistinct dots.

That drawback is particularly critical when using dot deflection control. Dot deflection control consists in performing several development steps during each print cycle to increase print resolution. For each development step, the symmetry of the electrostatic fields is modified in a specific direction, thereby influencing the transport trajectories of toner particles toward the image receiving medium. That method allows several dots to be printed through each single passage during the same print cycle, each deflection direction corresponding to a new dot location. To enhance the efficiency of dot deflection control, it is particularly essential to decrease the toner jet length (where the toner jet length is the time between the first particle emerging through the aperture and the last particle emerging through the aperture) and to ensure direct transition from a deflection direction to another, without delayed toner deposition.

Therefore, in order to achieve higher speed printing with improved print uniformity, and in order to improve dot deflection control, there is still a need to improve DEP methods to allow shorter toner transport time and reduce delayed toner deposition.

Additionally, in order to ensure entire coverage of the print area, the apertures are preferably aligned in several parallel rows arranged at a slight angle to each other, such that each aperture corresponds to a specific addressable area on the information carrier. The control electrode for each aperture is disposed around the aperture and encompasses an area greater than the aperture. When active, the control electrode has a release area, defined as the area in which toner is drawn from the toner carrier. Because the control electrode is disposed around the aperture, the release area is larger than the aperture diameter.

When printing a solid black surface, the amount of toner available decreases from row to row of apertures. When the release area of the apertures is too large, release areas of consecutive apertures overlap resulting in dots printed "downstream" having a lower density because of an insufficient amount of toner. Having an insufficient amount of toner downstream is known as "toner starvation." Toner starvation causes a degradation of the print uniformity because the dot density becomes dependent on which row the dots are printed through. Toner starvation results in printed surfaces which appear to be striped.

SUMMARY OF THE INVENTION

The present invention satisfies a need for improved DEP methods by providing high-speed transition from print conditions to non-print conditions and shorter toner transport time. The present invention also corrects for toner starvation by limiting the release area of toner.

The present invention satisfies a need for higher speed DEP printing without delayed toner deposition.

The present invention further satisfies high speed transition from a deflection direction to another, and thereby improved dot deflection control.

A DEP method in accordance with the present invention is performed in consecutive print cycles, each of which includes at least one development period $t_b$ and at least one recovering period $t_w$ subsequent to each development period $t_b$.

A pattern of variable electrostatic fields is produced during at least a part of each development period ($t_b$) to selectively permit or restrict the transport of charged toner particles from a particle source toward a back electrode. At the beginning of each development period, the transport of charged toner particles from the particle source is enhanced by a kick pulse. In particular, the electric field produced by the kick pulse generates a force to counteract the adhesion forces during a short duration at the beginning of each development period ($t_b$). Preferably, the combination of the amplitude and the duration of the kick pulse is sufficient to overcome the retention forces, but not sufficient to initiate toner transport in the absence of a control voltage to open an aperture. In other words, the kick pulse applies an additional force which temporarily counteracts the toner adhesion forces and thus facilitates toner release from the boundary of the developer sleeve surface. Therefore, the kick pulse allows the use of a higher charged toner material which is more strongly bound to the developer sleeve surface. Such higher charged toner material is quite difficult to utilize in the absence of the kick pulse at the beginning of the developer period.

Preferably, an electric field is produced during at least a part of each recovering period ($t_w$) to repel a part of the transported charged toner particles back toward the particle source.

The problem of toner starvation can be reduced by supplying the kick pulse not on the control electrode, but on the guard electrode disposed on the second surface of the printhead structure. The position of the guard electrode and the magnitude of the kick-pulse can be chosen to narrow the release area of the aperture.

By reducing the size of the release area, it is possible to deliver a more precise amount of toner to each aperture of each row. This allows the available toner to be shared equally among the different rows. For example, when utilizing four rows, the release areas may be adjusted so each row is provided with 25% of the total amount of toner supplied to the print zone during a print sequence.

A DEP method in accordance with the present invention includes the steps of:

providing a particle source, a back electrode and a printhead structure positioned therebetween, said printhead structure including an array of control electrodes connected to a control unit;

positioning an image receiving medium between the printhead structure and the back electrode; producing an electric potential difference between the particle source and the back electrode to apply an electric field which enables the transport of charged toner particles from the particle source toward the back electrode;

during each development period $t_b$, applying variable electric potentials to the control electrodes to produce a pattern of electrostatic fields which, due to control in accordance with an image configuration, open or close passages through the printhead structure to selectively permit or restrict the transport of charged particles from the particle source onto the image receiving medium; and during a first portion of each development period $t_b$, applying an additional electric field between the particle source and the control electrodes to enhance the transport of charged toner particles from the particle source toward the image receiving medium.

Preferably, during each recovering period ($t_w$), an electric shutter potential is applied to the control electrodes to produce an electric field which repels delayed toner particles back to the particle source.

According to the present invention, a printhead structure is preferably formed of a substrate layer of electrically insulating material, such as polyimid or the like, having a top surface facing the particle source, a bottom surface facing the image receiving medium and a plurality of apertures arranged through the substrate layer for enabling the passage of toner particles through the printhead structure. The top surface of the substrate layer is overlaid with a printed circuit including the array of control electrodes and arranged such that each aperture is at least partially surrounded by a control electrode.

Each control electrode is connected to at least one driving unit, such as a conventional integrated circuit (IC) driver which supplies variable control potentials having levels comprised in a range between $V_{off}$ and $V_{on}$, where $V_{off}$ and $V_{on}$ are chosen to be below and above a predetermined threshold level, respectively. The threshold level is determined by the force required to overcome the adhesion forces holding toner particles on the particle source. The adhesion forces are overcome in part by a kick voltage field applied between the particle source and the control electrodes. The kick voltage field has an insufficient magnitude to cause transport of toner particles; however, when combined with the variable control potentials, a sufficient voltage field is applied at the beginning of each write period to enhance the transport of toner particles from the toner source.

According to another embodiment of the present invention, the printhead structure further includes at least two sets of deflection electrodes comprised in an additional printed circuit preferably arranged on said bottom surface of the substrate layer. Each aperture is at least partially surrounded by first and second deflection electrodes disposed around two opposite segments of the periphery of the aperture. The first and second deflection electrodes are similarly disposed in relation to a corresponding aperture and are connected to first and second deflection voltage sources, respectively.

The first and second deflection voltage sources supply variable deflection potential D1 and D2, respectively, such that the toner transport trajectory is controlled by modulating the potential difference D1–D2. The dot size is controlled by modulating the amplitude levels of both deflection potentials D1 and D2, in order to produce converging forces for focusing the toner particle stream passing through the apertures.

Each pair of deflection electrodes are arranged symmetrically about a central axis of their corresponding aperture whereby the symmetry of the electrostatic fields remains unaltered as long as both deflection potentials D1 and D2 have the same amplitude.

In a preferred embodiment, all deflection electrodes are connected to at least one voltage source which supplies a periodic voltage pulse oscillating between a first voltage level, applied during each of said development periods $t_b$, and a second voltage level ($V_{shutter}$), applied during each of said recovering periods $t_w$. The shutter voltage level applied to the deflection electrodes may differ in voltage level and timing from the shutter voltage applied to the control electrodes.

According to that embodiment, a DEP method is performed in consecutive print cycles each of which includes at least two development periods $t_b$ and at least one recovering period $t_w$ subsequent to each development period $t_b$, wherein:

a pattern of variable electrostatic fields is produced during at least a part of each development period ($t_b$) to selectively permit or restrict the transport of charged toner particles from a particle source toward a back electrode;

during a first portion of each development period ($t_b$), a kick voltage is applied to generate an electric field to enhance the transport of charged toner particles from the particle source toward the back electrode;

for each development period ($t_b$), a pattern of deflection fields is produced to control the trajectory and the convergence of the transported toner particles; and an electric field is produced during at least a part of each recovering period ($t_w$) to repel a part of the transported charged toner particles back toward the particle source.

According to that embodiment, a DEP method includes the steps of:

producing an electric potential difference between the particle source and the back electrode to apply an electric field which enables the transport of charged toner particles from the particle source toward the back electrode;

during each development period $t_b$, applying variable electric potentials to the control electrodes to produce a pattern of electrostatic fields which, due to control in accordance with an image configuration, open or close passages through the printhead structure to selectively permit or restrict the transport of charged particles from the particle source onto the image receiving medium; and at the beginning of each development period $t_b$, a kick voltage field is applied between the particle source and the control electrodes to enhance the transport of toner particles from the particle source at the beginning of the development period; and during at least one development period $t_b$ of each print cycle, producing an electric potential difference D1–D2 between two sets of deflection electrodes to modify the symmetry of each of said electrostatic fields, thereby deflecting the trajectory of the transported particles.

Preferably, during each recovering period ($t_w$):

an electric shutter potential is applied to each set of deflection electrodes to create an electric field between the deflection electrodes and the back electrodes to accelerate toner particles to the image receiving medium; and the electric shutter potential is also applied to the control electrodes to produce an electric field between the control electrodes and the particle source to repel delayed toner particles back to the particle source.

According to the latter embodiment, the deflection potential difference is preserved during at least a part of each recovering period $t_w$, until the toner deposition is achieved. After each development period, a first electric field is produced between a shutter potential on the deflection electrodes and the background potential on the back electrode. Simultaneously, a second electric field is produced between a shutter potential on the control electrodes and the potential of the particle source (preferably 0V). The toner particles which, at the end of the development period $t_b$, are located between the printhead structure and the back electrode are accelerated toward the image receiving medium under influence of said first electric field. The toner particles which, at the end of the development period $t_b$, are located between the particle source and the printhead structure are repelled back onto the particle source under influence of said second electric field.

The present invention also refers to a control function in a direct electrostatic printing method, in which each print cycle includes at least one development period $t_b$ and at least one recovering period $t_w$ subsequent to each development period $t_b$. The variable control potentials are supplied to the control electrodes during at least a part of each development period $t_b$, and have amplitude and pulse width chosen as a function of the intended print density. During a first portion of each development period $t_b$, an additional electric field is applied to enhance the movement of toner particles. The shutter potential is applied to the control electrodes during at least a part of each recovering period $t_w$.

The present invention also refers to a direct electrostatic printing device for accomplishing the above method.

The objects, features and advantages of the present invention will become more apparent from the following description when read in conjunction with the accompanying figures in which preferred embodiments of the invention are shown by way of illustrative examples.

Although the examples shown in the accompanying Figures illustrate a method wherein toner particles have negative charge polarity, that method can be performed with particles having positive charge polarity without departing from the scope of the present invention. In that case all potential values will be given the opposite sign.

DETAILED DESCRIPTION OF THE PREFERRED EMBODIMENT

Description of the Shutter Pulse Improvement

Figure 1:
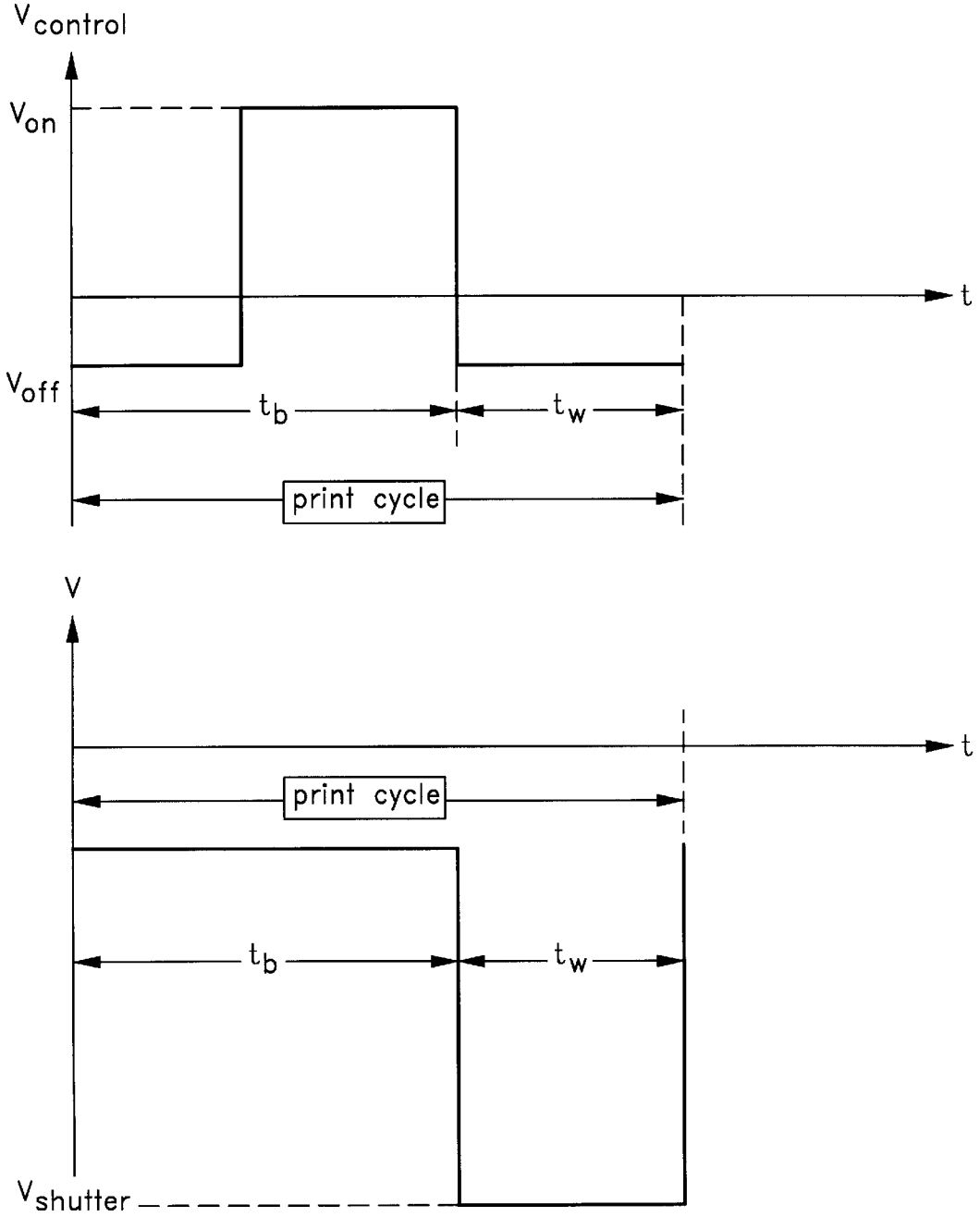
FIG. 1 is a diagram showing the voltages applied to a selected control electrode during a print cycle including a development period $t_b$ and a recovering period $t_w$.

FIG. 1 shows the control potential ($V_{control}$) and the periodic voltage pulse (V) applied on a control electrode during a print cycle. According to this example, the print cycle includes one development period $t_b$ and one subsequent recovering period $t_w$. The control potential ($V_{control}$) has an amplitude comprised between a white level $V_{off}$ and a full density level $V_{on}$. The control potential ($V_{control}$) has a pulse width which can vary between 0 and the entire development period $t_b$. When the pulse width is shorter than $t_b$, the whole control potential pulse is delayed so that it ends at $t=t_b$. At $t=t_b$, the periodic voltage pulse V is switched from a first level to a shutter level ($V_{shutter}$). The shutter potential has the same sign as the charge polarity of the toner particles, thereby applying repelling forces on the toner particles. Those repelling forces are directed away from the control electrodes whereby all toner particles which have already passed the apertures are accelerated toward the back electrode, while toner particles which are still located in the gap between the particle source and the control electrodes at $t=t_b$ are reversed toward the particle source.

Figure 2:
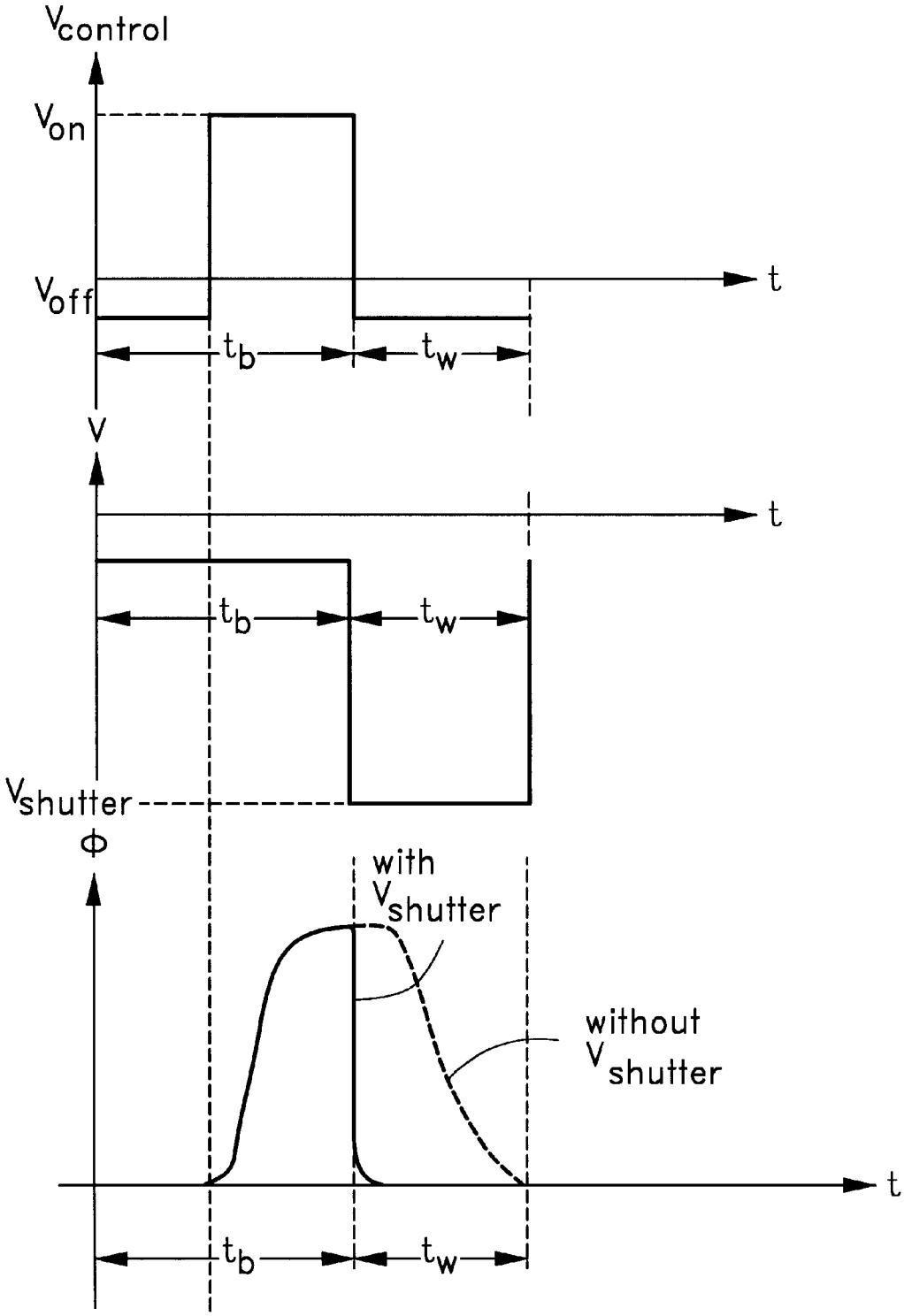
FIG. 2 is a diagram showing control function of FIG. 1 and the resulting particle flow density Φ, compared to prior art (dashed line).

As a result, the particle flow is cut off almost abruptly at $t=t_b$. FIG. 2 illustrates a print cycle as that shown in FIG. 1 and the resulting particle flow density, i.e., the number of particles passing through the aperture during a print cycle. The dashed line in FIG. 2 shows the particle flow density Φ as it would have been without applying a shutter potential (prior art). At t=0, toner particles are held on the particle source. As soon as the control potential is switched on, particles begin to be released from the particle source and projected through the aperture. The particle flow density Φ is rapidly shut off by applying the shutter potential at $t=t_b$.

Figure 3:
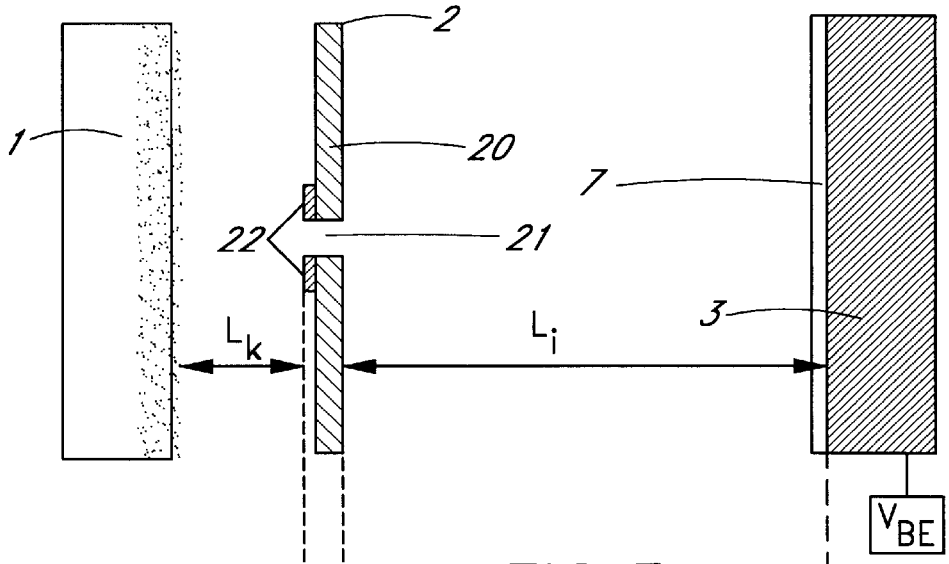
FIG. 3 is a schematic section view of a print zone of a DEP device.

FIG. 3 is a schematic section view through a print zone in a direct electrostatic printing device. The print zone comprises a particle source 1, a back electrode 3 and a printhead structure 2 arranged therebetween. The printhead structure 2 is located at a predetermined distance $L_k$ from the particle source and at a predetermined distance $L_i$ from the back electrode 3. A voltage $V_{BE}$ (relative to the particle source 1) is connected to the back electrode 3 to establish a background electric field potential between the particle source 1 and the back electrode 3 having a polarity selected to attract toner particles toward the back electrode 3. The printhead structure 2 controls the flow of toner particles through a plurality of apertures 21 formed therein.

Figure 9:
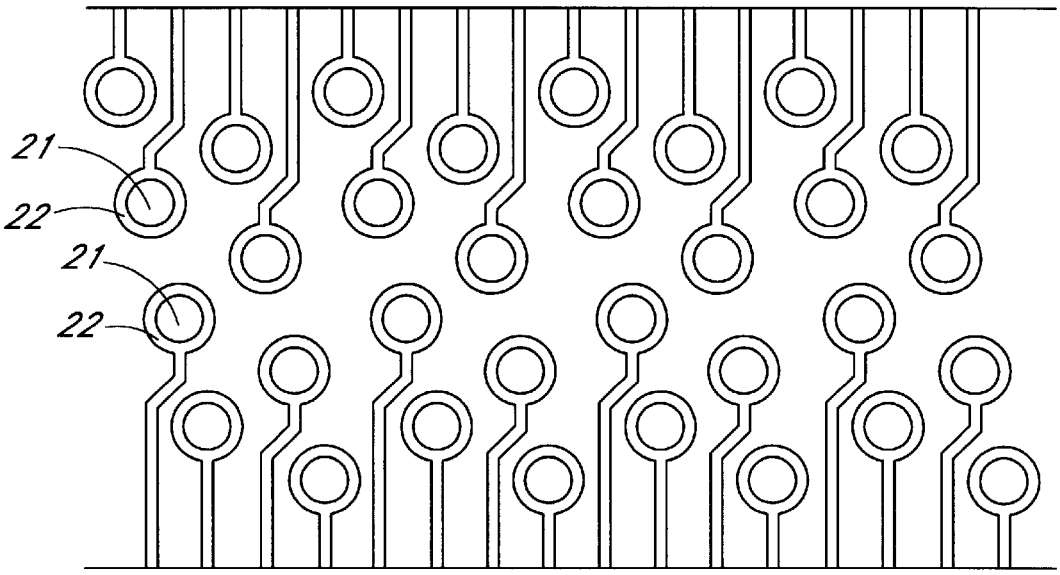
FIG. 9 illustrates an exemplary array of apertures surrounded by control electrodes.

The printhead structure 2 includes a substrate layer 20 of electrically insulating material having the plurality of apertures 21, arranged through the substrate layer 20, each aperture 21 being at least partially surrounded by a control electrode 22. The apertures 21 form an array, as illustrated, for example, in FIG. 9. An image receiving medium 7 is conveyed between the printhead structure 2 and the back electrode 3.

The particle source 1 is preferably arranged on a rotating developer sleeve having a substantially cylindrical shape and a rotation axis extending parallel to the printhead structure 2. The sleeve surface is coated with a layer of charged toner particles held on the sleeve surface by adhesion forces due to charge interaction with the sleeve material. The developer sleeve is preferably made of metallic material even if a flexible, resilient material is preferred for some applications. The toner particles are generally non-magnetic particles having negative charge polarity and a narrow charge distribution in the order of about 4 to 10 $\mu$C/g. The printhead structure is preferably formed of a thin substrate layer of flexible, non-rigid material, such as polyimid or the like, having dielectrical properties. The substrate layer 20 has a top surface facing the particle source and a bottom surface facing the back electrode, and is provided with a plurality of apertures 21 arranged therethrough in one or several rows extending across the print zone. Each aperture is at least partially surrounded by a preferably ring-shaped control electrode of conductive material, such as, for example, copper, arranged in a printed circuit preferably etched on the top surface of the substrate layer. Each control electrode is individually connected to a variable voltage source, such as a conventional IC driver, which, due to control in accordance with the image information, supplies the variable control potentials in order to at least partially open or close the apertures as the dot locations pass beneath the printhead structure. All control electrodes are connected to an additional voltage source which supplies the periodic voltage pulse oscillating from a first potential level applied during each development period $t_b$ and a shutter potential level applied during at least a part of each recovering period $t_w$.

Figure 4:
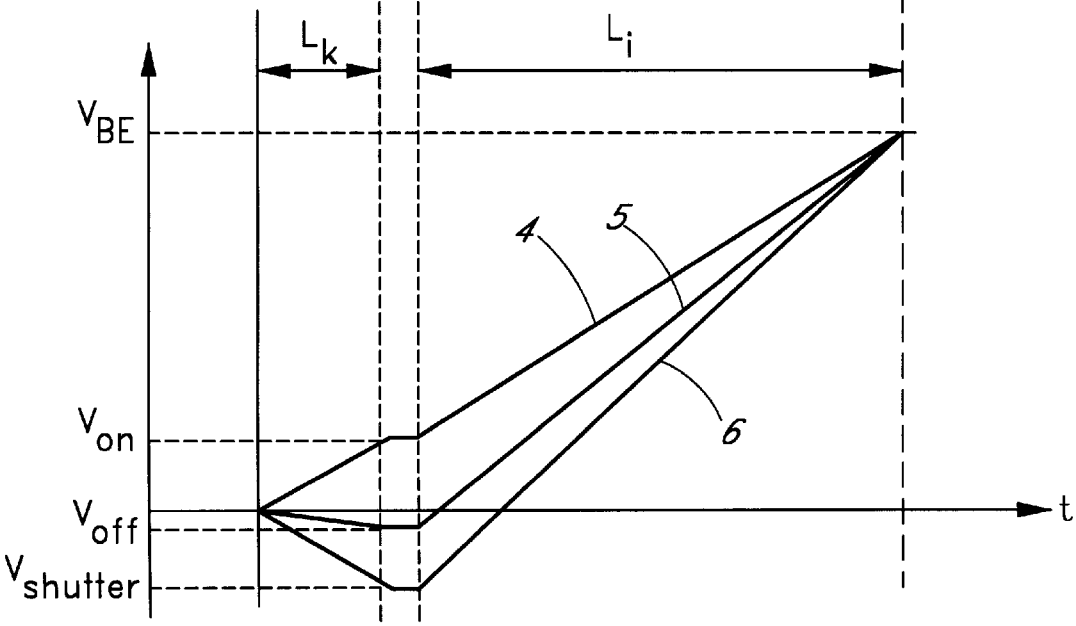
FIG. 4 is a diagram illustrating the electric potential as a function of the distance from the particle source to the back electrode, referring to the print zone of FIG. 3 .

FIG. 4 is a schematic diagram showing the applied electric potential as a function of the distance d from the particle source 1 to the back electrode 3. Line 4 shows the potential function during a development period $t_b$, as the control potential is set on print condition ($V_{on}$). Line 5 shows the potential function during a development period $t_b$, as the control potential is set in nonprint condition ($V_{off}$). Line 6 shows the potential function during a recovering period $t_w$, as the shutter potential is applied ($V_{shutter}$). As apparent from FIG. 4, a negatively charged toner particle located in the region is transported toward the back electrode as long as the print potential $V_{on}$ is applied (line 4) and is repelled back toward the particle source as soon as the potential is switched to the shutter level (line 6). At the same time, a negatively charged toner particle located in the $L_i$-region is accelerated toward the back electrode as the potential is switched from $V_{on}$ (line 4) to $V_{shutter}$ (line 6).

Although the shutter voltage is described above as being connected to the control electrodes 22 as a negative voltage to repel toner particles back toward the particle source 1, it should be understood that the shutter voltage can also be applied to the particle source as a positive voltage which attracts toner particles back to the particle source when the shutter voltage is active. Furthermore, the negative shutter voltage can be applied to other electrodes located on the printhead structure 2 to provide the repelling action.

Figure 5:
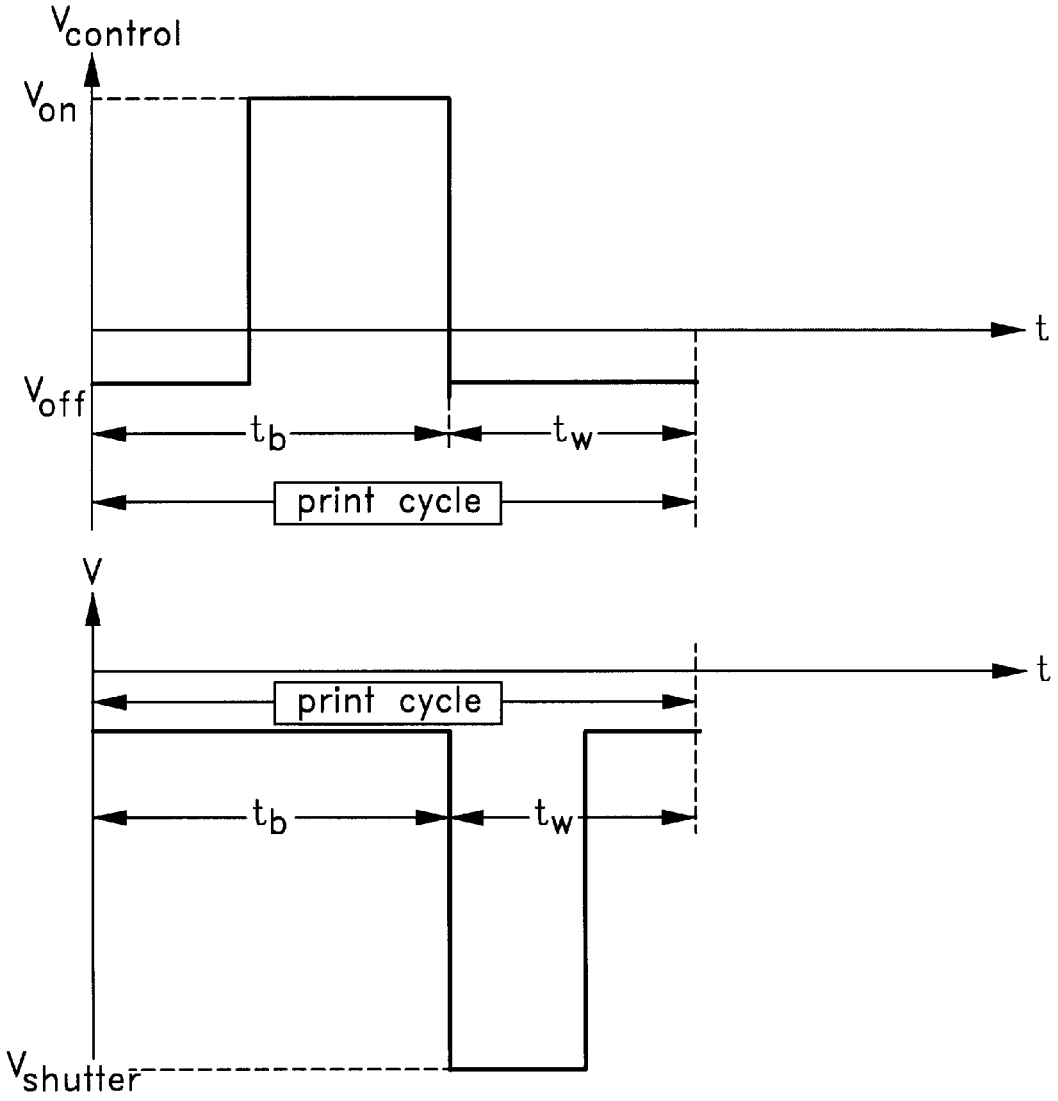
FIG. 5 is a diagram showing the voltages applied to a selected control electrode during a print cycle, according to another embodiment of the invention.

FIG. 5 shows an alternate embodiment of the invention, in which the shutter potential is applied only during a part of each recovering period $t_w$.

Figure 6:
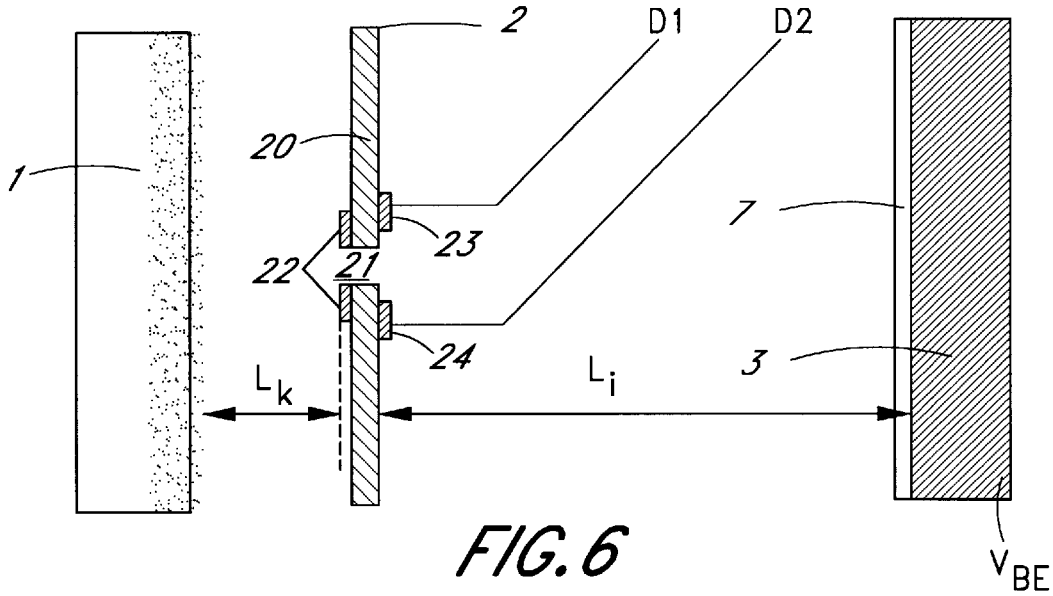
FIG. 6 is a schematic section view of a print zone of a DEP device according to another embodiment of the invention, in which the printhead structure includes deflection electrodes.

According to another embodiment of the present invention, shown in FIG. 6, the printhead structure 2 includes an additional printed circuit preferably arranged on the bottom surface of the substrate layer 20 and comprising at least two different sets of deflection electrodes 23, 24, each of which set is connected to a deflection voltage source (D1, D2). By producing an electric potential difference between both deflection voltage sources (D1, D2), the symmetry of the electrostatic fields produced by the control electrodes 22 is influenced in order to slightly deflect the transport trajectory of the toner particles.

Figure 7:
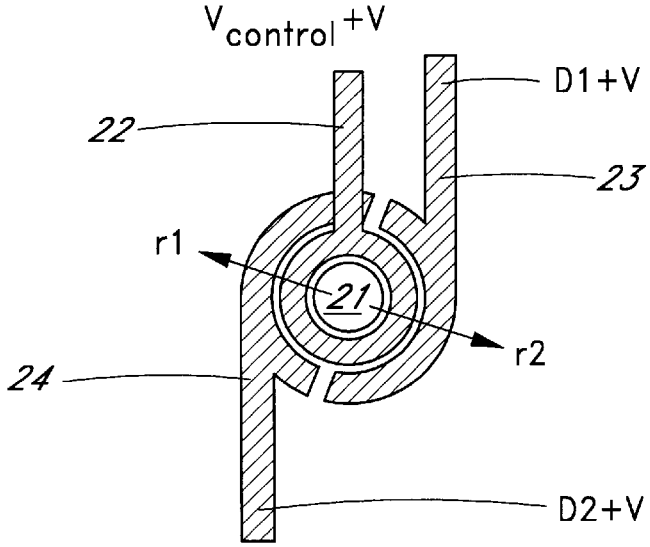
FIG. 7 is a schematic view of an aperture, its associated control electrode and deflection electrodes, and the voltages applied thereon.

As apparent from FIG. 7, the deflection electrodes 23, 24 are disposed in a predetermined configuration such that each aperture 21 is partly surrounded by a pair of deflection electrodes 23, 24 included in different sets. Each pair of deflection electrodes 23, 24 is so disposed around the apertures, that the electrostatic field remains symmetrical about a central axis of the aperture as long as both deflection voltages D1, D2 have the same amplitude. As a first potential difference (D1<D2) is produced, the stream is deflected in a first direction r1. By reversing the potential difference (D1>D2) the deflection direction is reversed to an opposite direction r2. The deflection electrodes have a focusing effect on the toner particle stream passing through the aperture and a predetermined deflection direction is obtained by adjusting the amplitude difference between the deflection voltages.

In that case, the method is performed in consecutive print cycles, each of which includes several, for example, two or three, development periods $t_b$, each development period corresponding to a predetermined deflection direction. As a result, several dots can be printed through each aperture during one and same print cycle, each dot corresponding to a particular deflection level. That method allows higher print resolution without the need of a larger number of control voltage sources (IC drivers). When performing dot deflection control, it is an essential requirement to achieve a high speed transition from one deflection direction to another.

Figure 8A:
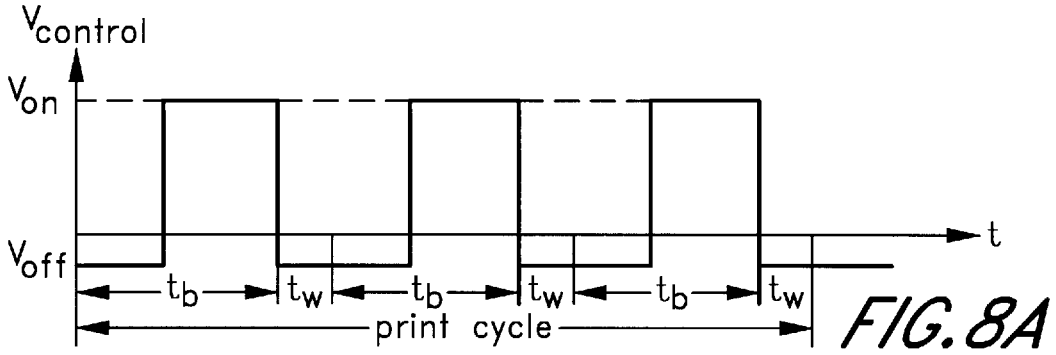
FIG. 8*a* is a diagram showing the control voltages applied to a selected control electrode during a print cycle including three development periods $t_b$ and three recovering periods $t_w$, utilizing dot deflection control.
Figure 8B:
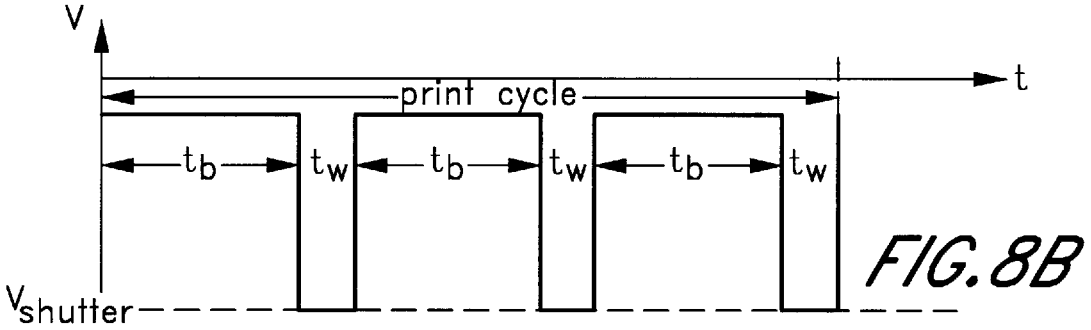
FIG. 8*b* is a diagram showing the periodic voltage pulse V applied to all control electrodes and deflection electrodes during a print cycle including three development periods $t_b$ and three recovering periods $t_w$, utilizing dot deflection control.
Figure 8C:
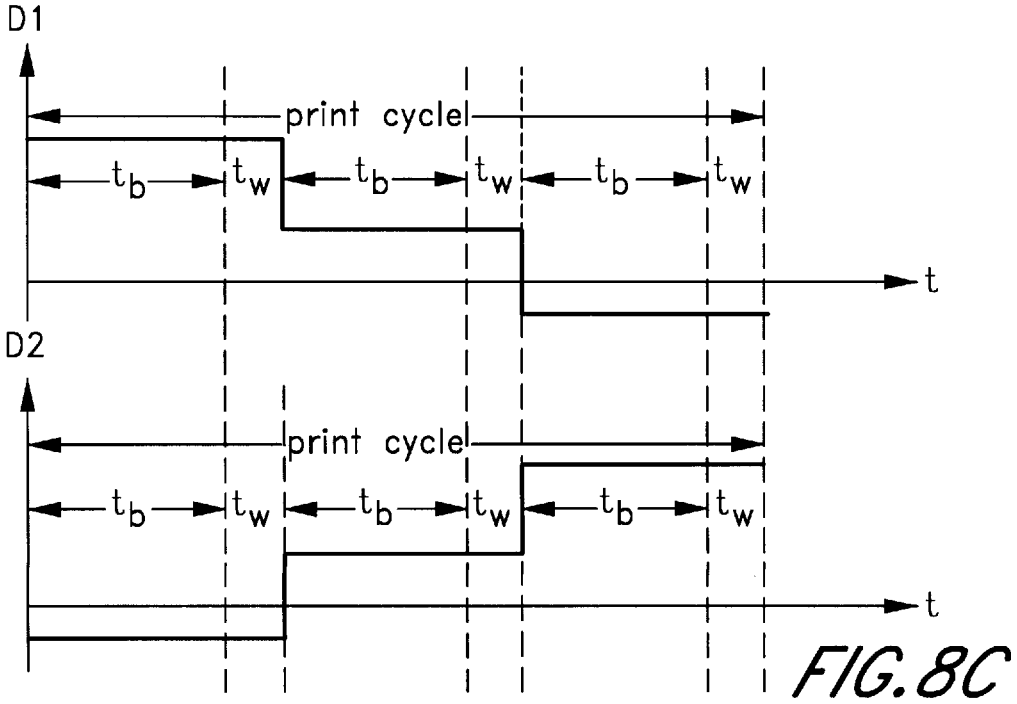
FIG. 8*c* is a diagram showing the deflection voltages D1 and D2 applied to first and second sets of deflection electrodes, respectively, utilizing dot deflection control with three different deflection levels.

The present invention is advantageously carried out in connection with dot deflection control, as apparent from FIG. 8*a*, 8*b*, 8*c*. FIG. 8*a* is a diagram showing the control voltages applied on a control electrodes during a print cycle including three different development periods $t_b$, each of which is associated with a specific deflection level, in order to print three different, transversely aligned, adjacent dots through one and same aperture.

FIG. 8*b* shows the periodic voltage pulse. According to a preferred embodiment of the invention, the periodic voltage pulse is simultaneously applied on all control electrodes and on all deflection electrodes. In that case each control electrode generates an electrostatic field produced by the superposition of the control voltage pulse and the periodic voltage pulse, while each deflection electrode generates a deflection field produced by the superposition of the deflection voltages and the periodic voltage pulse. Note that the shutter voltage in FIG. 8*b* applied to the deflection electrodes may advantageously differ from the shutter voltage in FIG. 5 applied to the control electrodes. For example, the deflection electrode shutter voltage may have a different wave shape or a different amplitude than the control electrode shutter voltage, and it may also be delayed with respect to the pulses applied to the control electrodes.

FIG. 8*c* shows the deflection voltages applied on two different sets of deflection electrodes (D1, D2). During the first development period, a potential difference D1>D2 is created to deflect the particle stream in a first direction. During the second development period, the deflection potentials have the same amplitude, which results in printing a central located dot. During the third development period, the potential difference is reversed (D1<D2) in order to obtain a second deflection direction opposed to the first. The superposition of the deflection voltages and the periodic pulse produce a shutter potential, while maintaining the deflection potential difference during each recovering period.

Although it is preferred to perform three different deflection steps (for example, left, center, right), the above concept is obviously not limited to three deflection levels. In some applications, two deflection levels (for example, left, right) are advantageously performed in a similar way. The dot deflection control allows a print resolution of, for example, 600 dpi (dots per inch) utilizing a 200 dpi printhead structure and performing three deflection steps. A print resolution of 600 dpi is also obtained by utilizing a 300 dpi printhead structure performing two deflection steps. The number of deflection steps can be increased (for example, four or five) depending on different requirements such as, for example, print speed, manufacturing costs or print resolution.

According to other embodiments of the invention, the periodic voltage pulse is applied only to all deflection electrodes or only to all control electrodes.

An image receiving medium 7, such as a sheet of plain untreated paper or any other medium suitable for direct printing, is caused to move between the printhead structure 2 and the back electrode 3. The image receiving medium may also consist of an intermediate transfer belt onto which toner particles are deposited in image configuration before being applied on paper or other information carrier. An intermediate transfer belt may be advantageously utilized in order to ensure a constant distance $L_i$ and thereby a uniform deflection length.

In a particular embodiment of the invention, the control potentials are supplied to the control electrodes using driving means, such as conventional IC drivers (push-pull) having typical amplitude variations of about 325V. Such an IC driver is preferably used to supply control potential in the range of −50V to +275V for $V_{off}$ and $V_{on}$, respectively. The periodic voltage pulse is preferably oscillating between a first level substantially equal to $V_{off}$ (i.e., about −50V) to a shutter potential level in the order of $-V_{on}$ (i.e., about −325V). The amplitude of each control potential determines the amount of toner particles allowed to pass through the aperture. Each amplitude level comprised between $V_{off}$ and $V_{on}$ corresponds to a specific shade of gray. Shades of gray are obtained either by modulating the dot density while maintaining a constant dot size, or by modulating the dot size itself. Dot size modulation is obtained by adjusting the levels of both deflection potentials in order to produce variable converging forces on the toner particle stream. Accordingly, the deflection electrodes are utilized to produce repelling forces on toner particles passing through an aperture such that the transported particles are caused to converge toward each other resulting in a focused stream and thereby a smaller dot. Gray scale capability is significantly enhanced by modulating those repelling forces in accordance with the desired dot size. Gray scale capabilities may also be enhanced by modulating the pulse width of the applied control potentials. For example, the timing of the beginning of the control pulse may be varied. Alternatively, the pulse may be shifted in time so that it begins earlier and no longer ends at the beginning of the shutter pulse.

Description of the Kick Pulse Improvement

Another area of concern with regard to direct electrostatic printing (DEP) is a problem with regard to the initial release of toner from the particle source 1 on the developer sleeve. In particular, a need has been found to either reduce the force holding the toner particles to the developer sleeve or increase the force exerted to pull the toner particles from the sleeve using the field resulting from the control electrodes. The present improvement increases the force exerted on the toner particles by increasing the field applied to pull the toner particles from the particle source 1 on the developer sleeve at the beginning of each development period ($t_b$) to thereby enhance the transport of toner particles from the particle source 1.

Presently, there are no economically practical, commercially available integrated circuits able to withstand the voltage necessary to provide a sufficient field. The present invention increases the field which pulls the toner particles from the particle source 1 without using a higher voltage on the integrated circuits and without pulling toner particles during the "no-print" condition (i.e., when no toner is to be applied to a particular location on the print medium).

Figure 10:
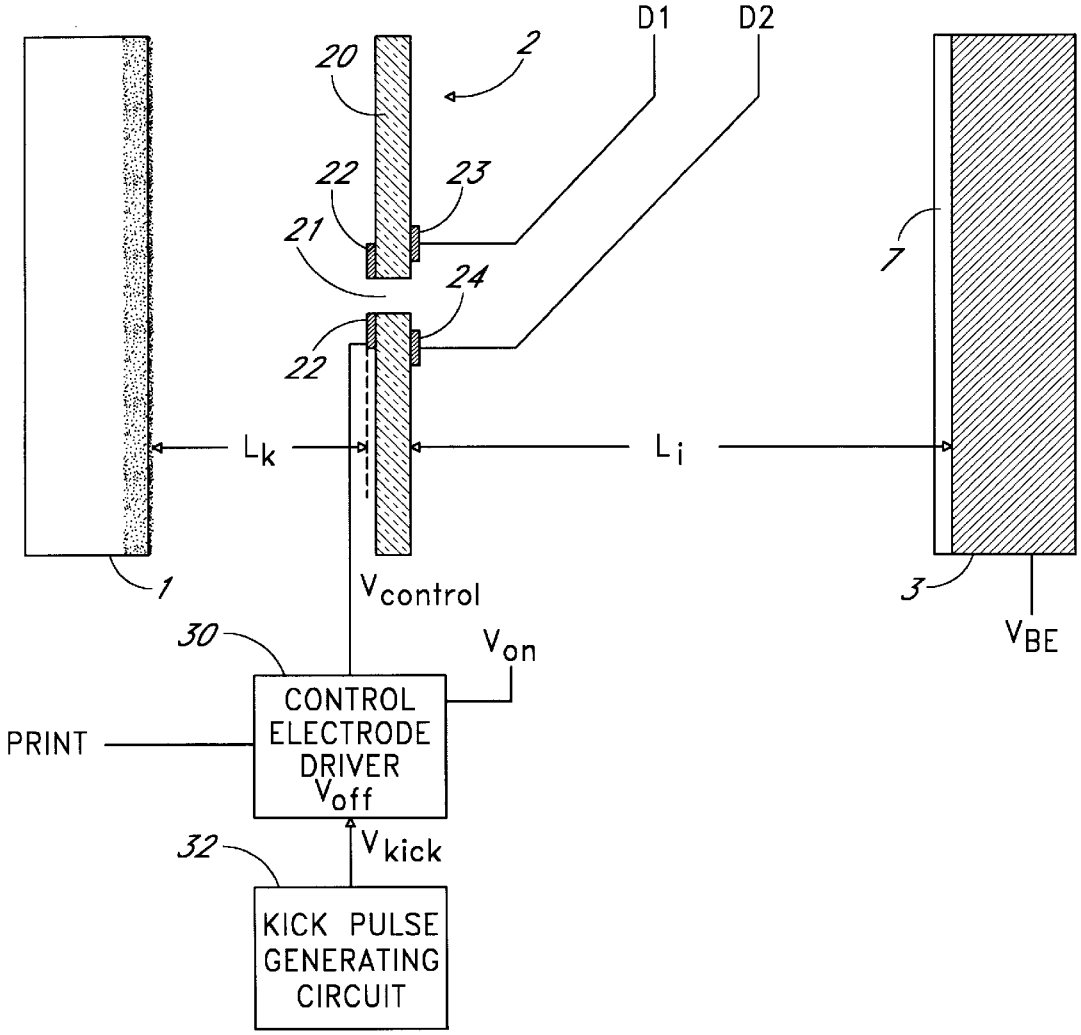
FIG. 10 illustrates the system of FIG. 6 with the addition of a kick voltage generator to enhance the propulsion of toner particles from the developer sleeve.
Figures 11A, 11B:
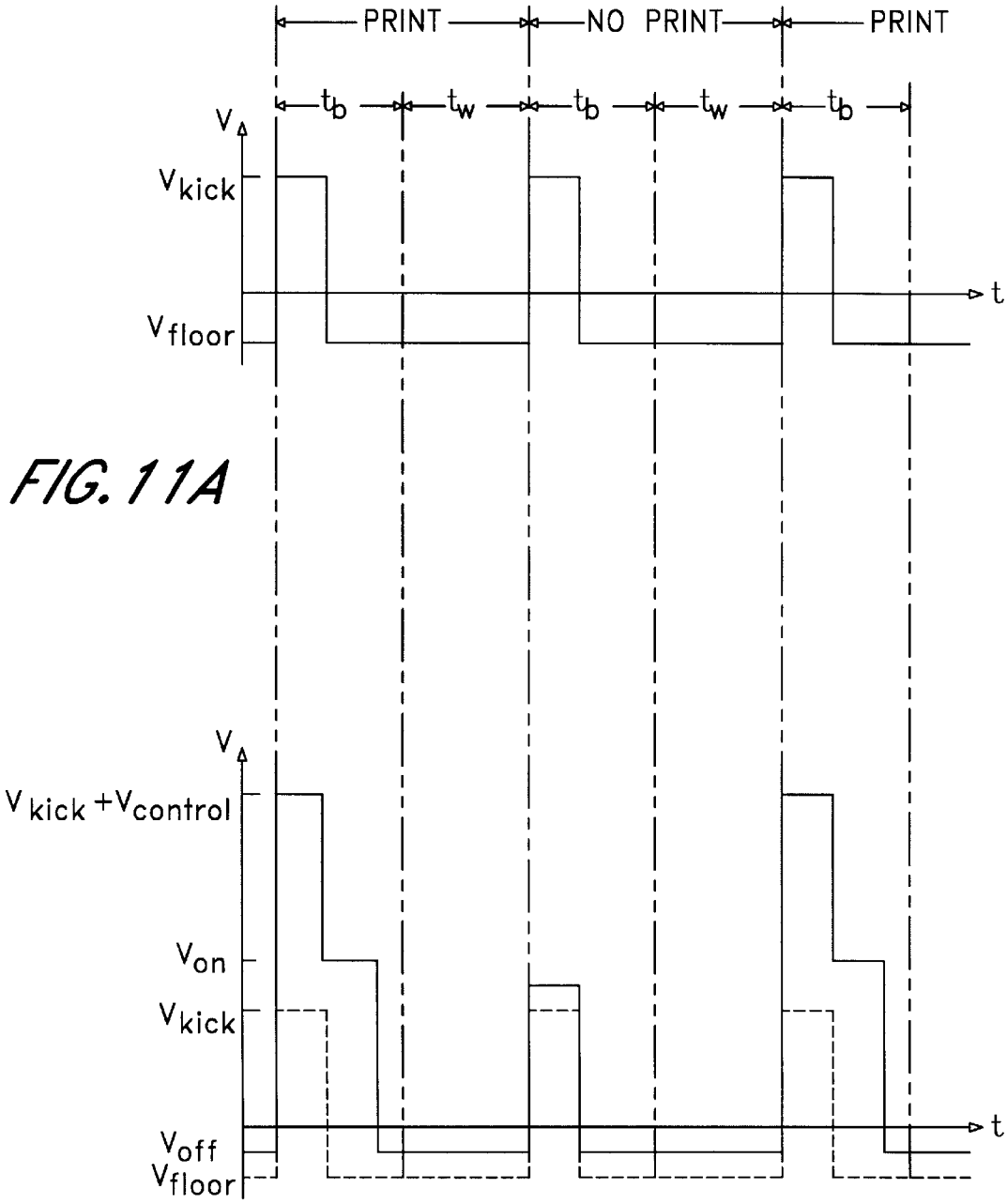
FIG. 11*a* illustrates a voltage waveform for the kick pulse in accordance with the present invention.
FIG. 11*b* illustrates a voltage waveform for the kick pulse in combination with the control voltage in accordance with the present invention.

To fulfill the requirement described above, the present invention modifies the offset potential level of the integrated circuits driving the control electrodes in the manner shown in FIGS. 10, 11*a* and 11*b*.

FIG. 10 illustrates a driving circuit 30 applied to the control electrode 22 from FIG. 6. FIGS. 11*a* and 11*b* illustrate the voltage waveforms applied to the control electrode 22. As illustrated in FIGS. 10, 11*a* and 11*b*, the driving circuit 30 receives a control signal "print" which is activated by a print controller (not shown) to cause the driving circuit 30 to apply the voltage $V_{on}$, to the control electrode 22 to "open" the aperture 21 and thereby permit toner particles to flow through the aperture 21 to the print medium. If the "print" signal is not active, the control voltage is maintained at $V_{off}$ to block toner particles through the aperture 21. The output voltage $V_{control}$ provided by the driving circuit 30 is generated with respect to an off voltage $V_{off}$ which represents the "white" (i.e., "no-print" voltage level). However, in FIG. 10, the off voltage $V_{off}$ is provided to the driving circuit 30 by a kick pulse generating circuit 32 so that the flat baseline $V_{off}$ is replaced by a pulsed baseline $V_{kick}$ caused by the kick pulse, as illustrated in FIG. 11*a*. As further illustrated in FIG. 11*a* and as discussed below, the maximum magnitude of the kick pulse is selected to be less than $V_{on}$ so that the kick pulse alone will not cause toner particles to be pulled from the particle source 1 and transported through the apertures 21. Alternatively, the maximum amplitude of the kick pulse can be equal to or greater than $V_{on}$, and the width of the kick pulses maintained sufficiently narrow (i.e., short in duration) so that any toner particles pulled from or repelled from the particle source do not gain sufficient momentum from the kick pulse alone to be transported through the apertures 21. In particular embodiments, it may be advantageous to have a higher kick pulse voltage and a shorter kick pulse width to overcome the adhesion forces of higher charged toner particles. Furthermore, the use of a higher kick voltage may permit the use of a smaller control voltage and thus a less expensive integrated circuit. Because there are many more control voltage drivers than kick voltage drivers, the use of less expensive integrated circuits for the control voltage drivers provides significant economic advantages.

The kick pulse is timed to turn on at approximately the same time as the beginning of each print pulse (i.e., when the control voltage $V_{control}$ is turned on to the $V_{on}$ magnitude or to a magnitude between $V_{off}$ and $V_{on}$ when providing gray-scale control of the print density). Thus, as illustrated in FIG. 11*b*, the control voltage applied to the control electrode 22 when the aperture 21 is to be opened to print, is the sum of $V_{control}$ and $V_{kick}$ during the duration of the kick pulse and then drops to $V_{on}$ for the remainder of the duration of the print pulse. In a preferred embodiment, each of the kick pulses has a duration of approximately 50 microseconds in comparison to the control voltage pulses which each have a duration of approximately 200–250 microseconds, when a dot is to be written.

As illustrated by the leftmost and rightmost waveforms in FIG. 11*b*, by replacing a flat baseline with a pulsed baseline, a much larger field is produced which pulls toner particles from the particle source 1 during the short $t_{kick}$ duration. During the remainder of the on time (which can be the entire duration of $t_b$ or a part of that time, as illustrated in FIG. 11*b*), the "normal" $V_b$-level (i.e., $V_{on}$) is applied to continue pulling toner particles from the particle source 1 and through the aperture 21. Applying the kick pulse at the beginning of $t_b$ provides a much better toner release, and also makes it possible to print with toner particles having a much higher charge than previously used.

The kick pulse operates to enhance the transport of toner particles from the particle source 1, but does not cause the transport of toner particles in the absence of a control voltage to open a particular aperture. In particular, the electric field produced by the kick pulse generates a force to counteract the adhesion forces during a short duration at the beginning of each development period ($t_b$). Preferably, the combination of the amplitude and the duration of the kick pulse is sufficient to overcome the retention forces, but not sufficient to initiate toner transport in the absence of a control voltage to open an aperture. In other words, the kick pulse applies an additional force which temporarily counteracts the toner adhesion forces and thus facilitates toner release from the boundary of the developer sleeve surface. Therefore, the kick pulse allows the use of a higher charged toner material which is more strongly bound to the developer sleeve surface. Such higher charged toner material is quite difficult to utilize in the absence of the kick pulse at the beginning of the developer period.

The kick pulse has an amplitude level and a pulse width which are selected to enhance the transport of toner particles without causing the transport of toner particles through an aperture in the absence of a control voltage set to $V_{on}$. The amplitude is adjusted to counteract retention forces on the boundary of the developer sleeve. The pulse width is selected to be sufficiently short to preclude toner transport through the "closed" apertures (i.e., in the non-print condition with the control voltage equal to $V_{off}$). That is, if the amplitude is too high, toner transport will be initiated, and if the pulse width is too long, toner will reach sufficient momentum to pass through a "closed" aperture in a non-print condition. Both the amplitude and the pulse width are adjusted so that, even if toner particles are extracted from the developer sleeve, the toner particles are immediately repelled back toward the developer sleeve under the influence of a control voltage set to a white (i.e., non-printing) potential. Only if the control voltage for an aperture is set to black (i.e., printing) potential will the toner particles pass through the respective aperture. In particular, after selecting the amplitude for the kick pulse, the pulse width is adjusted such that the toner particles never reach sufficient momentum to pass through an aperture set to non-writing potential.

In the illustrated embodiment, the kick pulse voltage is applied to all the driving circuits 30 at the same time. Because the kick pulse is also present when no dots should be printed, one feature of the present invention is that the magnitude and the duration of the kick pulse are selected so that the kick pulse alone is not sufficient to transport toner particles from the developer sleeve through the apertures 21 to the print medium when no control pulse is applied (i.e., when the control pulse remains at the white level). Thus, as illustrated by the middle waveform in FIG. 11*b,* although the kick pulse is applied at the beginning of the period $t_b$, the combination of the pulse width and the magnitude of the kick is selected so that no dot is produced on the print medium.

It should be understood that the kick pulse applied to each row of control electrodes may not be the same. In particular, because the developer sleeve forming the particle source 1 is curved, the distances from the surface of the developer sleeve to each row of apertures may not be the same. In such cases the control voltage needed to effect a printing condition (i.e., an "open aperture") may have to be different for each row to compensate for differences in the distances. Similarly, the amplitude of the kick voltage pulse may also have to be adjusted accordingly for each row.

Figure 12:
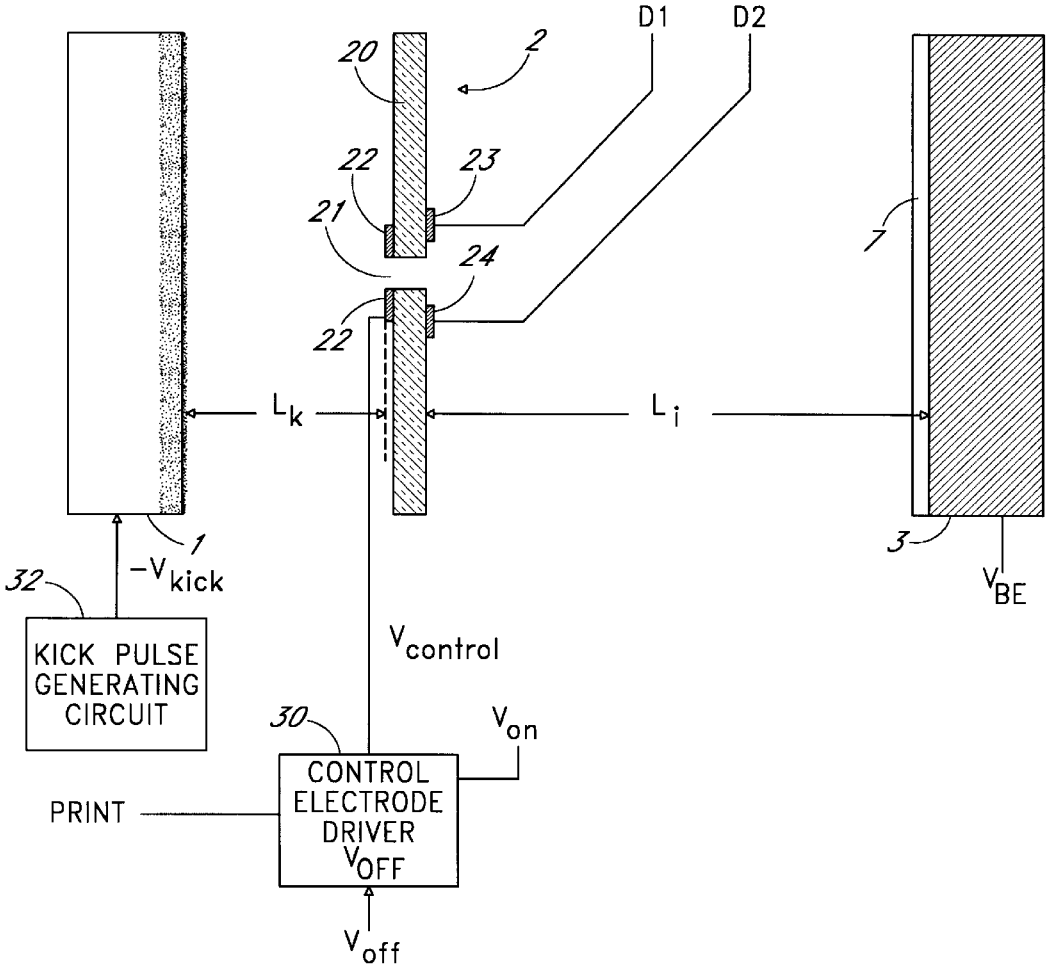
FIG. 12 illustrates an alternative embodiment to FIG. 10 in which the output of the kick voltage generator is applied to the particle source.

Another feature of the present invention is that the same effect (much better toner release) can be obtained by varying the developer sleeve potential in the corresponding manner by applying a kick pulse to the developer sleeve to bring the developer sleeve to a "kick potential" to repel the toner particles from the particle source 1 on the developer sleeve during the duration of $t_{kick}$. This embodiment is illustrated in FIG. 12. As in the embodiment of FIG. 10, the field strength is the key to causing the toner particles to be forced from the developer sleeve during $t_{kick}$. Thus, the kick-pulse potential can be applied either to the control electrodes or to the developer sleeve. It should be understood that because the kick pulse applied to the particle source 1 is repelling charged particles, its polarity must be opposite the polarity of the kick pulse shown in FIG. 10. Thus, the kick voltage applied to the particle source 1 in FIG. 12 is show as $-V_{kick}$.

Figures 13A, 13B:
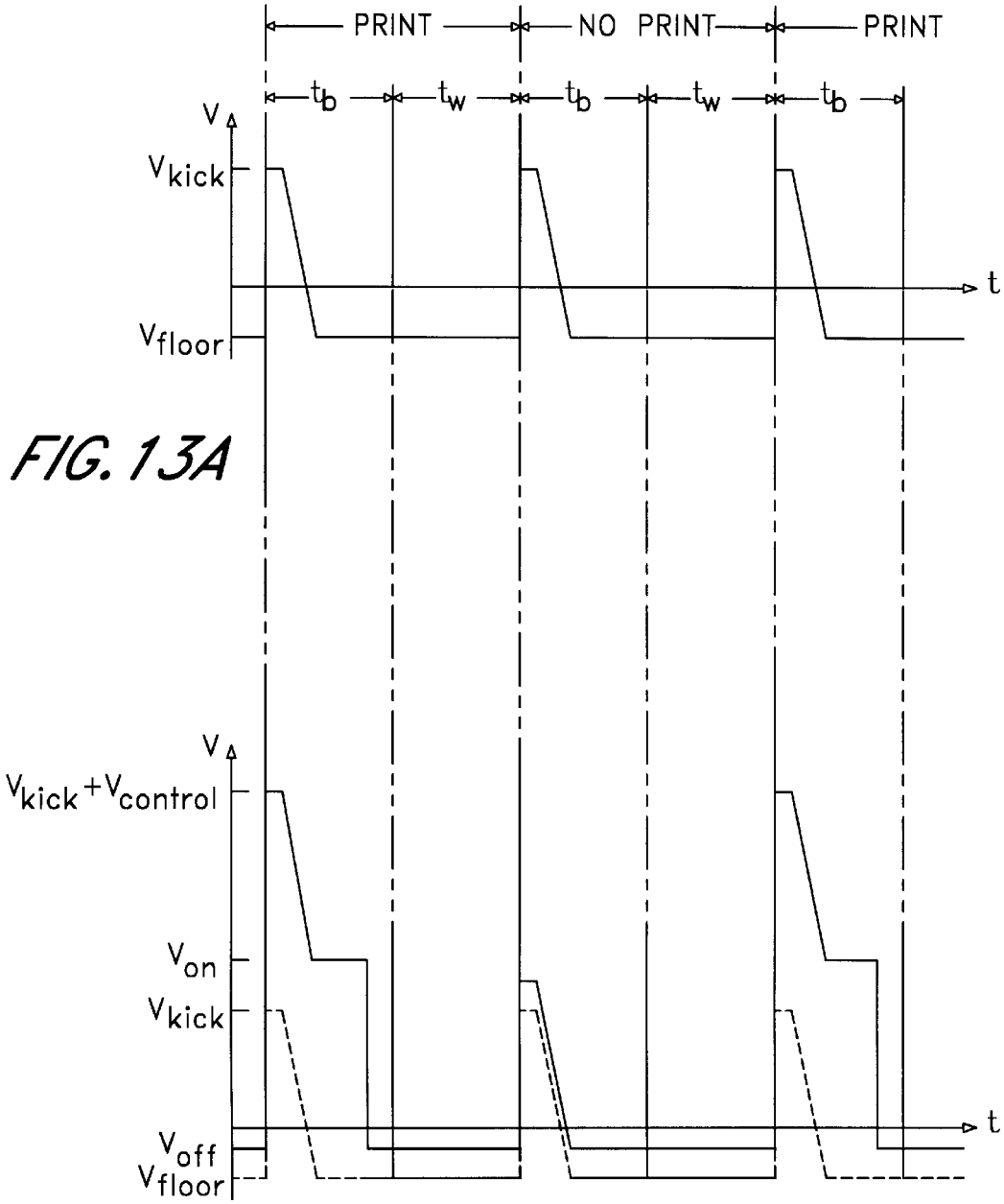
FIGS. 13*a* and 13*b* correspond to FIGS. 11*a* and 11*b* for an alternative waveform shape for the kick pulse.

The shape of the kick pulse in FIG. 11*a* is a rectangular pulse. There are other shapes which will also accomplish the present invention. For example, rather than stepping the control voltage $V_{control}$ down from $V_{kick}$ to $V_w$ or to $V_{floor}$, the control voltage can be advantageously ramped between $V_{kick}$ and the lower voltage, as illustrated in FIGS. 13*a* and 13*b*.

In particular embodiments, the kick pulse can be applied to shield electrodes (i.e., electrodes in the same plane as the control electrodes or on the developer side of the flexible printed circuit board on which the electrode array is formed which are used to avoid cross-coupling between control electrodes and to hinder the dot deflection electrodes from pulling toner particles). The kick pulse can also be applied to the dot deflection electrodes 23 and 24 (FIGS. 6 and 7) or to guard electrodes (see FIG. 15 discussed below).

Figures 14A, 14B:
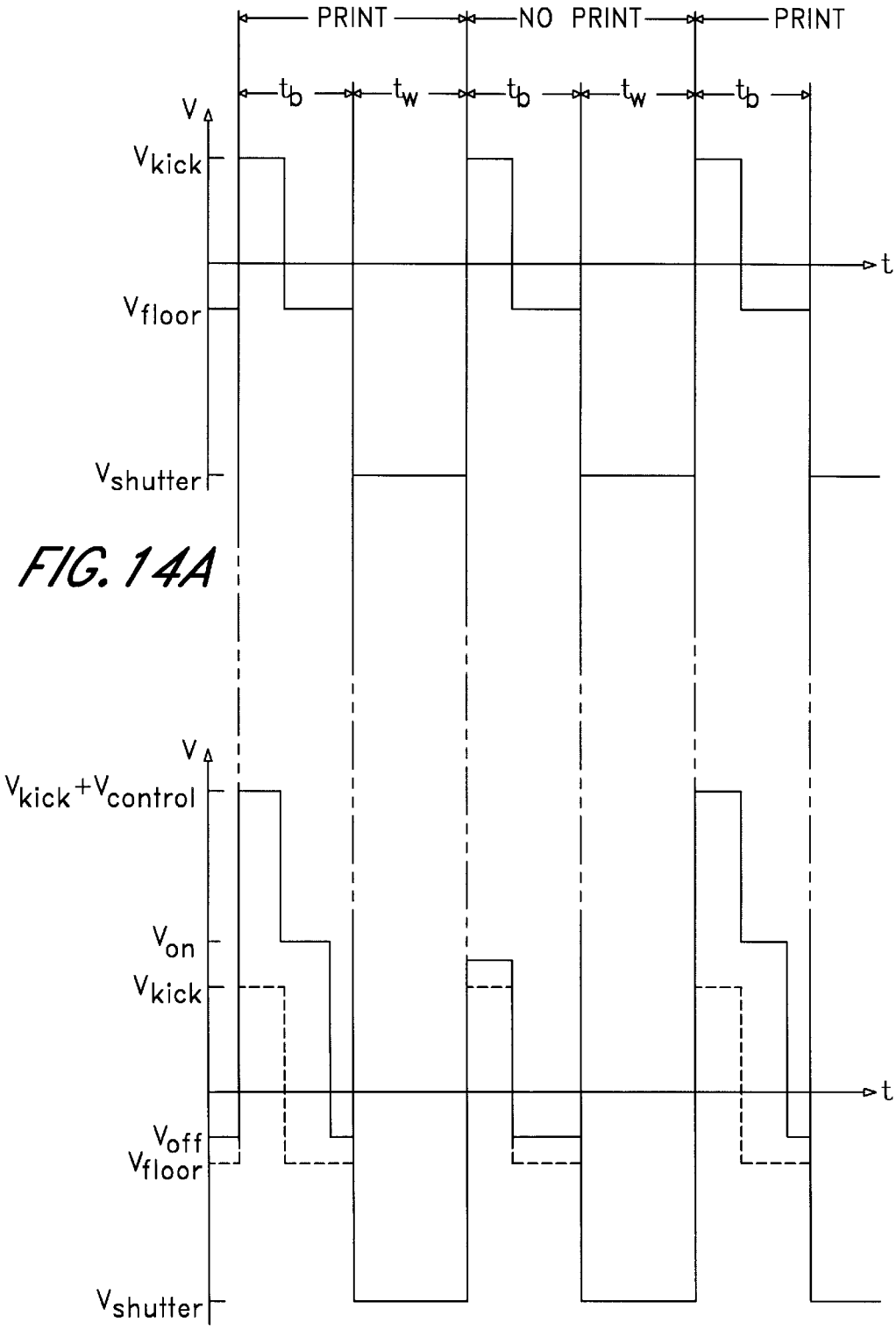
FIG. 14*a* illustrates a voltage waveform for the kick pulse superimposed on the shutter voltage in accordance with a further embodiment of the present invention.
FIG. 14*b* illustrates a voltage waveform for the kick pulse superimposed on the shutter voltage in combination with the control voltage in accordance with the further embodiment of the present invention.

As illustrated in FIGS. 14*a* and 14*b,* the kick pulse can also be used in combination with the shutter voltage described above. In particular, FIG. 14*a* illustrates the combined kick voltage pulse and the shutter voltage pulse, and FIG. 14*b* illustrates the kick voltage pulse, the shutter voltage pulse and the control voltage pulse. As illustrated in FIG. 14*a,* at the beginning of the print period, when the shutter voltage is off (i.e., at its higher (more positive) voltage level), the kick pulse is initially turned on for a selected duration. Thereafter, the kick voltage is turned off, and the sum of the kick voltage and the shutter voltage returns to the common off voltage $V_{off}$. Thereafter, at the end of the print period, the shutter voltage turns on causing the sum of the two voltages to decrease (i.e., become more negative) to the magnitude $V_{shutter}$. Although shown as two voltage sources, it should be understood that the kick pulse and the shutter voltage can be supplied by a single voltage source having three voltage levels, $V_{kick}$, $V_{floor}$ and $V_{shutter}$.

As illustrated in FIG. 14*b,* when the kick voltage and the shutter voltage are combined with the control voltage, the voltage waveform applied to the control electrode has a shape that depends on whether the aperture is to "open" to permit toner particles to flow (i.e., to print) or whether the aperture is to remain "closed" to block flow of toner particles. As illustrated by the leftmost waveform and the rightmost waveform in FIG. 14*b,* when the aperture is opened, the waveform has a first voltage level $V_{kick}+V_{control}$ for the duration of the kick pulse, a second voltage level $V_{on}$ during the remaining active portion of the control pulse, and a third voltage level $V_{floor}$ for the remaining duration of $t_b$. Thereafter, the voltage drops to the $V_{shutter}$ level for the duration of the recovery period $t_w$. As discussed above in connection with FIG. 5, the shutter voltage level may be active for only a portion of the recovering period $t_w$, if desired for some applications.

As further illustrated by the middle waveform in FIG. 14*b,* when the aperture is to remain closed, the voltage waveform starts at the level $V_{kick}$ at the beginning of the period $t_b$. As discussed above, this voltage is insufficient to cause toner particles to be pulled from the particle source 1 and pass through the apertures 21. At the end of the kick pulse, the control voltage drops to $V_{floor}$ for the duration of the period $t_b$, and then drops to $V_{shutter}$ for the recovering period $t_w$.

As discussed above, it should be understood that the waveforms in FIGS. 14*a* and 14*b* can be generated by the driving circuit 30 or can represent a differential voltage between the control voltage provided by the driving circuit and the kick voltage applied to the particle source 1. As further alternatives, the kick voltage can be applied to the deflection electrodes or to shield electrodes, as discussed above.

Figure 15:
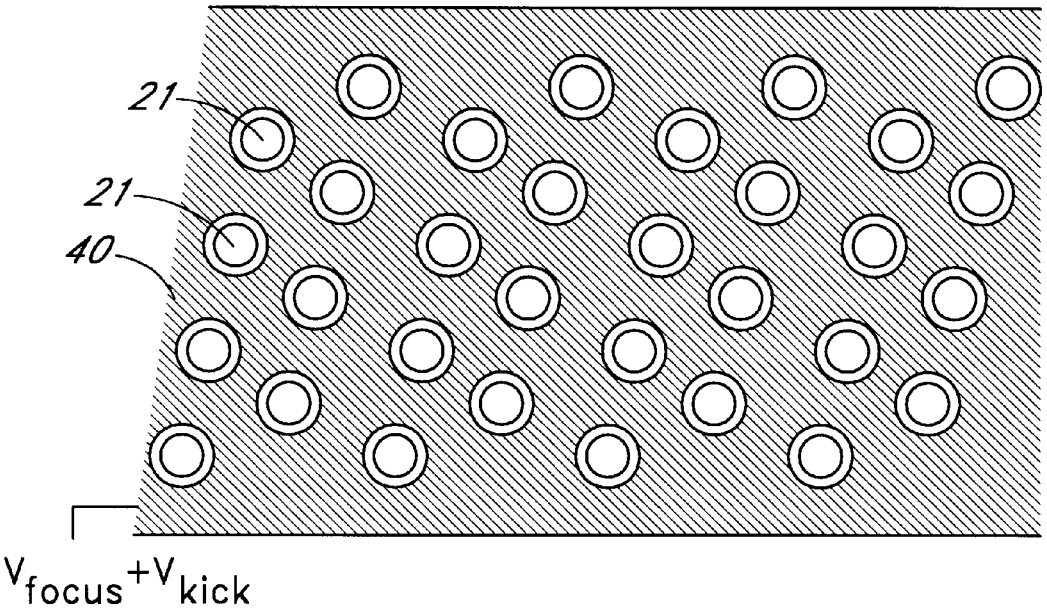
FIG. 15 illustrates a focusing electrode surrounding the apertures of FIG. 9 on an opposite side from the control electrodes of FIG. 9.

In a further alternative embodiment illustrated in FIG. 15, each aperture 21 is advantageously surrounded by a focusing (or guard) electrode 40 disposed upon the side of the printhead structure 2 opposite the control electrodes 22. As described in more detail in Applicant's copending U.S. patent application Ser. No. 08/757,972, a focusing voltage $V_{focus}$ can be applied to the focusing electrodes 40 to control the electric field between the aperture and the back electrode 3 to thereby concentrate the distribution of the toner particles in the particle stream passing through each aperture 21 about the central axis of the aperture 21. Although shown as a common focusing electrode plane in FIG. 15, as described in Applicant's copending application, each focusing electrode 40 can be formed around a single aperture 21 and connected to an independent focusing voltage, or, in the further alternative, the focusing electrodes 40 can be connected in rows to control the focus of an entire row of apertures 21 with the same focusing voltage. In any of the embodiments, the kick pulse is advantageously connected to the focusing electrode 40 so that during the initial portion of the development period the electrostatic field is increased to enhance the transport of charged toner particles, as described above, and in the remaining portion of the development period, the focusing voltage is applied to the focusing electrode 40 to focus the particle stream, as described in Applicant's copending patent application.

Figure 16A:
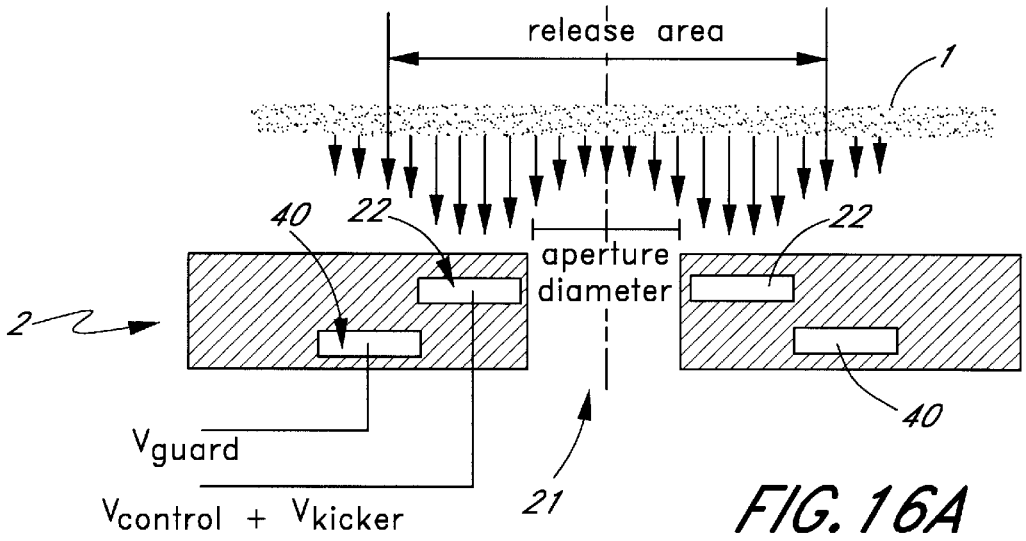
FIG. 16*a* is a schematic view of an aperture, its associated control electrode and guard electrodes, and the release area resulting therefrom when the kick pulse is applied to the control electrode.

FIG. 16*a* illustrates the release area obtained when the kick pulse is applied to the control electrode 22. Because of the proximity of the control electrode 22 to the particle source 1, the release force is higher above the control electrode 22 than above a central axis of the aperture 21. This results in a release area which is relatively large compared to the aperture diameter.

Figure 16B:
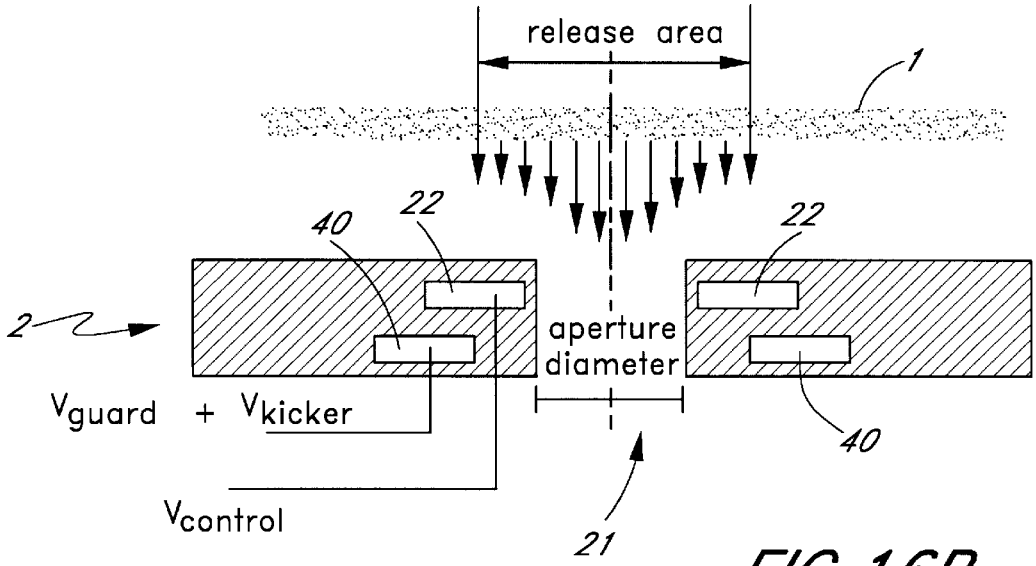
FIG. 16*b* is a schematic view of the aperture of FIG. 16*b* with the sizes of the release areas controlled by applying the kick pulse to the guard electrode.

Applying the kick pulse to the focusing, or guard electrode 40 has an additional advantage of narrowing the release area of the toner. FIG. 16*b* illustrates the release area obtained when the kick pulse is applied to the guard electrode 40. Because the guard electrode 40 is disposed farther from the particle source 1, the release force is lower above the control electrode 22 than above a central axis of the aperture 21. This results in a release area which is closer in size to the aperture diameter. By controlling the magnitude of the kick pulse, the size of the release area can be refined to more closely equal the size of the aperture diameter.

Figure 17:
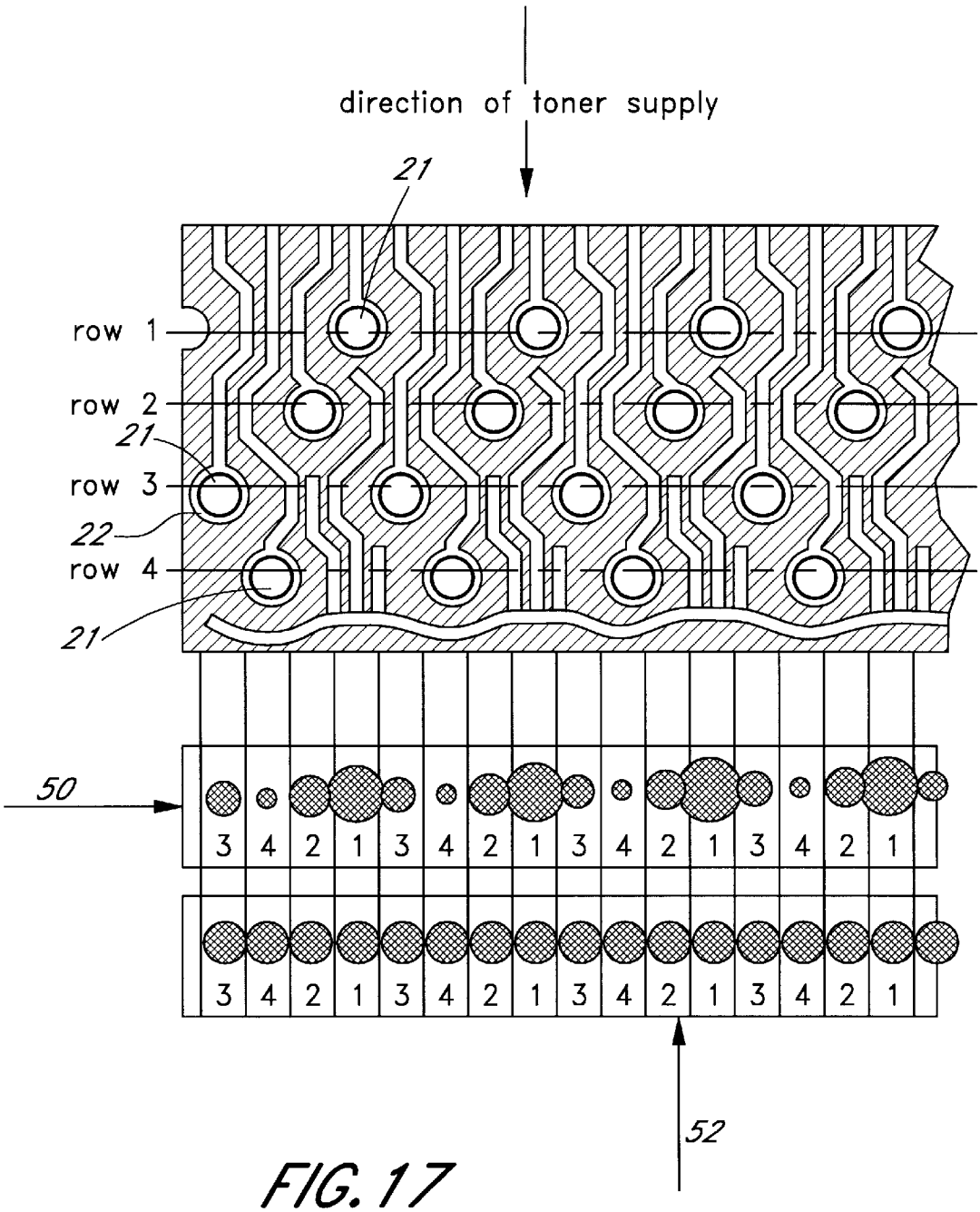
FIG. 17 illustrates the toner distribution patterns resulting from the configurations of FIGS. 16*a* and 16*b*.

FIG. 17 illustrates the toner distribution resulting from the apertures 21 of FIGS. 16*a* and 16*b*. An array of apertures 21 having four rows is shown. Of course, the array may have any number of rows without departing from the spirit of the invention. Supplying the control electrodes 22 with the kick pulse as in FIG. 16*a* results in an uneven toner distribution pattern 50. Toner is supplied to the array in the direction indicated. When the toner is first supplied to the apertures 21 in row 1, there is the full amount of toner available and the apertures 21 pull toner from a wide release area (FIG. 16*a*). Because a large amount of toner is available, the resulting dot printed from the apertures 21 in row 1 is large as illustrated in the uneven toner distribution pattern 50.

The wide release area of the apertures 21 in row 1 overlaps the release area of the apertures 21 in rows 2 and 3. Because the apertures 21 in row 1 have already used some of the toner in the release area of rows 2 and 3, there is less toner available for use by rows 2 and 3. The total amount of toner available to the apertures 21 in row 2 is less than the amount of toner used by row 1, and therefore the resulting dot size is decreased as shown in the uneven toner distribution pattern 50.

At this point, much more than half of the available toner has been used but only half the printing is complete. The wide release area of row 2 overlaps the release area of the apertures 21 in rows 3 and 4. This leaves rows 3 and 4 with a small amount of toner to complete the printing cycle. As a result, the dot sizes printed from rows 3 and 4 will be much smaller than the dot sizes printed from rows 1 and 2. As each row is printed, less toner is available for the remaining rows and therefore the dot size becomes progressively smaller as shown in the uneven toner distribution pattern 50.

Printing with a wide release area resulting in the uneven toner distribution pattern 50 results in print surfaces which are intended to be covered by toner (solid black) being striped periodically in the direction of the paper motion. To correct this problem, the present invention narrows the release area by applying the kick pulse to the guard electrodes 40, as illustrated in FIG. 16*b*. When the release area is approximately the same size as the aperture diameter, an even toner distribution pattern 52 results.

When the release area is approximately the same size as the aperture diameter, each aperture 21 only draws toner from the area immediately above the aperture 21. In this embodiment as illustrated by the distribution pattern 52 in FIG. 17, the apertures 21 in row 1 draw toner from a limited area above each aperture 21, and the resultant dot size may be more precisely controlled. Because the toner is only drawn from above the aperture 21, the subsequent rows 2, 3 and 4 have the same amount of toner available. This allows each aperture 21 in each row to print the same size dot, resulting in the even toner distribution pattern 52.

From the foregoing, it will be recognized that numerous variations and modifications may be effected without departing from the scope of the invention as defined in the appended claims.

What is claimed is:

1. A direct electrostatic printing method performed in consecutive print cycles, each of which includes at least one development period ($t_b$) and at least one recovering period ($t_w$) subsequent to each development period ($t_b$), the method comprising the steps of:

producing a pattern of variable electrostatic fields on a plurality of control electrodes proximate to apertures during at least a part of each development period ($t_b$) to selectively permit or restrict the transport of charged toner particles from a particle source through said apertures toward a back electrode, said variable electrostatic field for one of said control electrodes having a first polarity to permit transport of toner particles through a respective one of said apertures and having a second polarity to restrict transport of toner particles through said respective one of said apertures; and producing a supplemental electric field during a first portion of each development period, said supplemental electric field having a polarity selected with respect to said charged toner particles to enhance the transport of toner particles from said particle source toward said back electrode, said supplemental electric field having an insufficient magnitude to cause transport of toner particles through said respective one of said apertures when said plurality of control electrodes for said apertures has said electrostatic field selected to restrict transport of toner particles.

2. The method as defined in claim 1, wherein said supplemental electric field is produced by at least one voltage source which generates a kick voltage which increases from a first voltage level to a second voltage level during said first portion of the development period and which returns to the first voltage level before the end of said development period.

3. The method as defined in claim 2, wherein said pattern of variable electrostatic fields is generated by applying control voltages to a plurality of electrodes and wherein said supplemental electric field is generated by applying said kick voltage to said plurality of electrodes with a polarity selected to attract toner from said particle source.

4. The method as defined in claim 2, wherein said pattern of electrostatic fields is generated by applying control voltages to a plurality of electrodes and wherein said supplemental electric field is generated by applying said kick voltage to said particle source with a polarity selected to repel toner particles from said particle source.

5. The method as defined in claim 2, wherein said kick voltage increases rapidly from said first voltage level to said second voltage level, is maintained at said second voltage level for a selected duration, and then returns rapidly to said first voltage level.

6. The method as defined in claim 2, wherein said kick voltage increases rapidly from said first voltage level to said second voltage level at a first rate, is maintained at said second voltage level for a selected duration, and then returns to said first voltage level at a second rate less than said first rate.

7. The method as defined in claim 1, wherein a repelling electric field is produced during at least a part of each recovering period ($t_w$) to repel a part of the transported charged toner particles back toward the particle source.

8. The method as defined in claim 7, in which the repelling electric field is produced by a periodic voltage pulse oscillating from a first amplitude level applied during each development period ($t_b$) and a second amplitude level, applied during at least a part of each recovering period ($t_w$).

9. The method as defined in claim 8, in which the second amplitude level has the same sign as the charge polarity of the charged toner particles.

10. The method as defined in claim 1, in which the pattern of variable electrostatic fields is produced by a plurality of voltage sources, which due to control in accordance with an image configuration, supply variable control potentials to an array of control electrodes arranged between the particle source and the back electrode.

11. The method as defined in claim 1, in which a part of the transported toner particles are deposited in image configuration on an image receiving medium caused to move between the particle source and the back electrode.

12. The method as defined in claim 1, in which:

an electric potential difference is produced between the particle source and the back electrode to produce an electric field which enables the transport of toner particles from the particle source toward the back electrode; and the pattern of variable electrostatic fields influences said electric field to permit or restrict the transport of toner particles in accordance with an image configuration.

13. The method as defined in claim 1, wherein said supplemental electric field is produced by applying a voltage potential to a guard electrode which surrounds at least one of said apertures, said guard electrode further being used to focus said charged particles passing through said at least one of said apertures.

14. A direct electrostatic printing method performed in consecutive print cycles, each of which includes at least one development period ($t_b$) and at least one recovering period ($t_w$) subsequent to each development period, said method comprising the steps of:

providing a particle source, a back electrode and a printhead structure positioned therebetween, said printhead structure including an array of control electrodes;

providing an image receiving medium between the array of control electrodes and the back electrode;

producing a background electric field between the particle source and the back electrode to enable the transport of charged toner particles from the particle source toward the image receiving medium;

during each development period ($t_b$), applying variable electric potentials to the control electrodes to produce a pattern of electrostatic fields which, due to control in accordance with an image configuration, selectively permit or restrict the transport of charged particles from the particle source onto the image receiving medium; and connecting a supplemental voltage from at least one supplemental voltage source to generate a supplemental electric field between said particle source and said back electrode during a first portion of said development period, said supplemental electric field having a polarity selected to enhance the transport of charged particles from the particle source toward the image receiving medium, said supplemental electric field having a magnitude selected to be sufficient to increase transport of charged particles when transport is permitted by one of said control electrodes, said magnitude being insufficient to cause transport of charged particles from said particle source when transport is restricted by said one of said control electrodes.

15. The direct electrostatic printing method as defined in claim 14, wherein said supplemental electric field has a same polarity as said background electric field and is produced by applying said supplemental voltage to said control electrodes such that a total electric field is increased between said particle source and said back electrode during said first portion of said development period to counteract an adhesion force of said charged particles to said particle source.

16. The direct electrostatic printing method as defined in claim 14, wherein said supplemental electric field has a same polarity as said background electric field and is produced by applying said supplemental voltage to said particle source such that a total electric field is increased between said particle source and said back electrode during said first portion of said development period to counteract an adhesion force of said charged particles to said particle source.

17. The direct electrostatic printing method as defined in claim 14, further including the step of connecting at least one voltage source to all control electrodes to supply a periodic voltage pulse which oscillates between a first potential level, applied during each development period ($t_b$), and a second potential level ($V_{shutter}$), applied during at least a part of each recovering period ($t_w$) to repel delayed toner particles back toward the particle source.

18. The direct electrostatic printing method as defined in claim 17, wherein said supplemental voltage and said periodic voltage are generated by a single voltage source having at least three output levels.

19. The direct electrostatic printing method as defined in claim 14, in which said variable electric potentials have amplitude levels comprised between $V_{off}$ and $V_{on}$, where $V_{off}$ corresponds to nonprint conditions and $V_{on}$ corresponds to full density printing.

20. The direct electrostatic printing method as defined in claim 14, in which said variable electric potentials have pulse widths comprised between 0 and $t_b$ where 0 corresponds to nonprint conditions and $t_b$ corresponds to full density printing.

21. The direct electrostatic printing method as defined in claim 14, in which said variable electric potentials have variable pulse widths, each pulse width corresponding to an intended print density.

22. The direct electrostatic printing method as defined in claim 14, in which said variable electric potentials have variable pulse widths.

23. The direct electrostatic printing method as defined in claim 22, in which said variable electric potentials are simultaneously switched off at the end of each development period $t_b$.

24. The direct electrostatic printing method as defined in claim 14, in which:

said variable electric potentials have amplitude levels comprised between $V_{off}$ and $V_{on}$, where $V_{off}$ corresponds to nonprint conditions and $V_{on}$ corresponds to full density printing; and said supplemental voltage comprises a periodic voltage pulse having a first potential level substantially equal to $V_{off}$ and having a second potential level and a pulse width selected so that an adhesion force of said charged particles with respect to said particle source is counteracted without causing said charged particles to be transported to said back electrode.

25. The direct electrostatic printing method as defined in claim 24, wherein said supplemental voltage is less than $V_{on}$.

26. The direct electrostatic printing method as defined in claim 14, wherein said supplemental electric field is produced by applying a voltage potential to a guard electrode, said guard electrode further being used to focus said charged particles onto said image receiving medium.

27. A direct electrostatic print unit including:

a particle source;

a back electrode;

a background voltage source connected to the back electrode to produce an electric potential difference between the back electrode and the particle source;

a printhead structure positioned between the back electrode and the particle source, comprising:

a substrate layer of electrically insulating material having a top surface facing the particle source and a bottom surface facing the back electrode;

a plurality of apertures arranged through the substrate layer;

a printed circuit arranged on said top surface of the substrate layer, including a plurality of control electrodes, each of which at least partially surrounds a corresponding aperture;

a plurality of control voltage sources, each of which is connected to a corresponding control electrode to supply variable electric potentials to control a stream of charged toner particles through the corresponding aperture during each development period $t_b$; and at least one voltage source connected with reference to said control electrodes and said particle source to supply a periodic voltage pulse at the beginning of each development period $t_b$ to enhance the transport of toner particles from said particle source through the corresponding aperture at the beginning of each development period $t_b$.

28. A direct electrostatic printing device as defined in claim 27, in which the printhead structure further includes:

a second printed circuit preferably arranged on said bottom surface of the substrate layer, including at least two sets of deflection electrodes;

at least one deflection voltage source connected to each set of deflection electrodes to supply deflection potentials which control a transport trajectory of toner particles; and at least one voltage source connected to each set of deflection electrodes to supply a periodic voltage pulse to cut off the stream of charged toner particles after each development period $t_b$.

29. A direct electrostatic printing method performed in consecutive print cycles, each of which includes at least two development periods ($t_b$) and at least one recovering period ($t_w$) subsequent to each development period, the method comprising the steps of:

producing a pattern of variable electrostatic fields during at least a part of each development period ($t_b$) to selectively permit or restrict the transport of charged toner particles from a particle source toward a back electrode;

producing a pattern of deflection fields to influence the trajectory of the transported charged toner particles; and producing an electric field during a first part of each development period ($t_b$) to enhance the transport of toner particles from said particle source toward said back electrode.

30. The method as defined in claim 29, in which the electric field is produced by a periodic voltage pulse oscillating from a first amplitude level applied during a beginning of each development period ($t_b$) and a second amplitude level during a remainder of said development period $t_b$ and during said recovering period ($t_w$).

31. The method as defined in claim 29, in which the pattern of deflection fields is applied during at least one development period ($t_b$).

32. The method as defined in claim 31, in which the pattern of deflection fields is applied at the same time as the pattern of electrostatic fields.

33. The method as defined in claim 29, in which the pattern of deflection fields is applied during at least one development period ($t_b$) and during at least a part of a subsequent recovering period ($t_w$).

34. The method as defined in claim 33, in which the pattern of deflection fields is applied at the same time as the pattern of electrostatic fields.

35. The method as defined in claim 29, in which each development period ($t_b$) corresponds to a predetermined pattern of deflection fields.

36. The method as defined in claim 29, in which each development period ($t_b$) corresponds to a predetermined pattern of deflection fields, each pattern corresponding to a predetermined trajectory of the transported particles.

37. The method as defined in claim 29, in which each development period ($t_b$) corresponds to a predetermined pattern of deflection fields, each pattern being producing during the corresponding development period ($t_b$) and at least a part of its subsequent recovering period ($t_w$).

38. A direct electrostatic printing method performed in consecutive print cycles, each of which includes at least two development periods ($t_b$) and at least one recovering period ($t_w$) subsequent to each development period, the method comprising the steps of:

providing a particle source, a back electrode, and a printhead structure positioned therebetween, said printhead structure including an array of control electrodes and at least two sets of deflection electrodes;

providing an image receiving medium between the array of control electrodes and the back electrode;

producing an electric potential difference between the particle source and the back electrode to enable the transport of charged toner particles from the particle source toward the image receiving medium;

during each development period ($t_b$), applying variable electric potentials to the control electrodes to produce a pattern of electrostatic fields which, due to control in accordance with an image configuration, selectively permit or restrict the transport of charged toner particles from the particle source onto the image receiving medium;

supplying a first variable deflection potential D1 to a first set of the at least two sets of deflection electrodes, and a second variable deflection potential D2 to a second set of the at least two sets of deflection electrodes;

during at least one development period ($t_b$), producing an electric potential difference between D1 and D2 to influence the symmetry of said electrostatic fields, thereby deflecting the transport trajectory of toner particles in a predetermined deflection direction; and connecting at least one voltage source to all control electrodes to supply a periodic voltage pulse which oscillates between a first potential level, applied during each development period ($t_b$), and a second potential level ($V_{kick}$) applied during a beginning of each development period to enhance the transport of toner particles from said particle source toward said back electrode.

39. The method as defined in claim 38, further including an additional voltage source $V_{shutter}$ applied to said control electrodes during at least a part of each recovering period ($t_w$) to repel delayed toner particles back toward the particle source.

40. The method as defined in claim 39, in which each print cycle includes three development periods ($t_b$), and one recovering period ($t_w$) subsequent to each development period, wherein:

the transport trajectory of toner particles is deflected in a first direction during a first development period ($t_b$) and its subsequent recovering period ($t_w$), forming a first deflected dot on one side of a central dot;

the transport trajectory of toner particles is undeflected during a second development period ($t_b$) and its subsequent recovering period ($t_w$) forming said central dot; and the transport trajectory of toner particles is deflected in a second direction during a third development period ($t_b$) and its subsequent recovering period ($t_w$) forming a second deflected dot on the opposite side of the central dot.

41. The method as defined in claim 38, in which each print cycle includes two development periods ($t_b$), and one recovering period ($t_w$) subsequent to each development period.

42. A direct electrostatic printing method performed in consecutive print cycles, each of which includes at least one development period ($t_b$) and at least one recovering period ($t_w$) subsequent to each development period ($t_b$), the method comprising the steps of:

producing a pattern of variable electrostatic fields on a plurality of control electrodes proximate to apertures during at least a part of each development period ($t_b$) to selectively permit or restrict the transport of charged toner particles from a particle source through said apertures toward a back electrode, said variable electrostatic field for one of said control electrodes having a first polarity to permit transport of toner particles through a respective one of said apertures and having a second polarity to restrict transport of toner particles through said respective one of said apertures; and producing a supplemental electric field on a plurality of guard electrodes during a first portion of each development period, said supplemental electric field having a polarity selected with respect to said charged toner particles to enhance the transport of toner particles from said particle source toward said back electrode, said supplemental electric field having an insufficient magnitude to cause transport of toner particles through said respective one of said apertures when said control electrode for said apertures has said electrostatic field selected to restrict transport of toner particles.

43. The method as defined in claim 42, wherein the supplemental electrical field produced on the guard electrodes attracts toner particles from a release area approximately the same size as a diameter of one of said apertures.

44. The method as defined in claim 43, wherein the amount of toner transported through each of said apertures is approximately the same in each consecutive print cycle.

45. A direct electrostatic printing method performed in consecutive print cycles, each of which includes at least one development period ($t_b$) and at least one recovering period ($t_w$) subsequent to each development period, said method comprising the steps of:

providing a particle source, a back electrode and a printhead structure positioned therebetween, said printhead structure including an array of control electrodes and guard electrodes;

providing an image receiving medium between the array of control electrodes and the back electrode;

producing a background electric field between a particle source and a back electrode to enable the transport of charged toner particles from the particle source toward the image receiving medium;

during each development period ($t_b$) applying variable electric potentials to the control electrodes to produce a pattern of electrostatic fields which, due to control in accordance with an image configuration, selectively permit or restrict the transport of charged particles from the particle source onto the image receiving medium; and connecting a supplemental voltage from at least one supplemental voltage source to the guard electrodes to generate a supplemental electric field between said particle source and said back electrode during a first portion of said development period, said supplemental electric field having a polarity selected to enhance the transport of charged particles from the particle source toward the image receiving medium, said supplemental electric field having a magnitude selected to be sufficient to increase transport of charged particles when transport is permitted by one of said control electrodes, said magnitude being insufficient to cause transport of charged particles from said particle source when transport is restricted by said one of said control electrodes.

46. The method as defined in claim 45, wherein the supplemental electrical field produced attracts toner particles from a release area approximately the same size as a diameter of one of said apertures.

47. The method as defined in claim 46, wherein the amount of toner transported through each of said apertures is approximately the same in each consecutive print cycle.

48. A direct electrostatic printing method performed in consecutive print cycles, each of which includes at least two development periods ($t_b$) and at least one recovering period ($t_w$) subsequent to each development period, the method comprising the steps of:

producing a pattern of variable electrostatic fields during at least a part of each development period ($t_b$) to selectively permit or restrict the transport of charged toner particles from a particle source toward a back electrode;

producing a pattern of deflection fields to influence the trajectory of the transported charged toner particles; and producing an electric field by a guard electrode during a first part of each development period ($t_b$) to enhance the transport of toner particles from said particle source toward said back electrode.

49. The method as defined in claim 48, wherein the electric field produced by the guard electrode attracts toner particles from a release area approximately the same size as a diameter of one of said apertures.

50. The method as defined in claim 49, wherein the amount of toner transported through each of said apertures is approximately the same in each consecutive print cycle.

51. A direct electrostatic print unit including:

a particle source;

a back electrode;

a background voltage source connected to the back electrode to produce an electric potential difference between the back electrode and the particle source;

a printhead structure positioned between the back electrode and the particle source, comprising:

a substrate layer of electrically insulating material having a top surface facing the particle source and a bottom surface facing the back electrode;

a plurality of apertures arranged through the substrate layer;

a printed circuit arranged on said top surface of the substrate layer, including a plurality of control electrodes, each of which at least partially surrounds a corresponding aperture;

a printed circuit arranged on said bottom surface of the substrate layer, including a plurality of guard electrodes, each of which at least partially surrounds a corresponding aperture;

a plurality of control voltage sources, each of which is connected to a corresponding control electrode to supply variable electric potentials to control the stream of charged toner particles through the corresponding aperture during each development period $t_b$; and at least one voltage source connected to said guard electrodes to supply a periodic voltage pulse at the beginning of each development period $t_b$ to enhance the transport of toner particles from said particle source through the corresponding aperture at the beginning of each development period $t_b$.

* * * * *